US010293353B2

(12) United States Patent
Casper et al.

(10) Patent No.: US 10,293,353 B2
(45) Date of Patent: May 21, 2019

(54) AUTOMATED FLOWABLE MATERIAL DISPENSERS AND RELATED METHODS FOR DISPENSING FLOWABLE MATERIAL

(71) Applicant: GPCP IP HOLDINGS LLC, Atlanta, GA (US)

(72) Inventors: Ted Allen Casper, Kaukauna, WI (US); Ayanna Malene Bernard, Norcross, GA (US); Jose Olavo Martins F. Salles, Pulaski, WI (US); Ryan Andersen, Appleton, WI (US); Eric Paul Peterson, Mount Horeb, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

(21) Appl. No.: 15/881,737

(22) Filed: Jan. 27, 2018

(65) Prior Publication Data

US 2018/0304288 A1 Oct. 25, 2018

Related U.S. Application Data

(60) Provisional application No. 62/490,009, filed on Apr. 25, 2017.

(51) Int. Cl.
*B05B 9/04* (2006.01)
*B05B 11/00* (2006.01)
(Continued)

(52) U.S. Cl.
CPC ..... *B05B 9/0403* (2013.01); *A47K 5/1207* (2013.01); *A47K 5/1211* (2013.01);
(Continued)

(58) Field of Classification Search
CPC .... B05B 9/0403; A47K 5/1211; A47K 5/1217
(Continued)

(56) References Cited

U.S. PATENT DOCUMENTS 722,523 A 3/1903 Magidson
1,582,645 A 4/1926 Findley
(Continued)

FOREIGN PATENT DOCUMENTS

CN 2486091 4/2002
DE 202006002677 7/2006
(Continued)

OTHER PUBLICATIONS

"HYSO D3 Micro" dated Oct. 1, 2009.
"HYSO D3 Micro Automatic Door Handle Sanitizer" dated May 3, 2011.

*Primary Examiner* — Vishal Pancholi
(74) *Attorney, Agent, or Firm* — Evershed Sutherland (US) LLP

(57) ABSTRACT

An automated flowable material dispenser for dispensing flowable material from a flowable material container is provided. The dispenser may include a dispenser housing and a motor assembly. The dispenser housing may include a dispensing opening and be configured to receive the flowable material container therein. The motor assembly may be positioned within the dispenser housing and configured to translate with respect to the dispenser housing between a home position and a dispensing position to dispense the flowable material from the flowable material container. The motor assembly may include a motor housing and a motor positioned at least partially within the motor housing.

20 Claims, 25 Drawing Sheets

(51) Int. Cl.

| | |
|---|---|
| ***B05B 15/30*** | (2018.01) |
| ***B05B 12/12*** | (2006.01) |
| ***A47K 5/12*** | (2006.01) |
| ***A47K 10/38*** | (2006.01) |
| ***A47K 10/32*** | (2006.01) |
| ***B05B 9/043*** | (2006.01) |

(52) U.S. Cl.
CPC ..... *A47K 5/1217* (2013.01); *A47K 10/3836* (2013.01); *B05B 9/043* (2013.01); *B05B 11/0059* (2013.01); *B05B 15/30* (2018.02); *A47K 2010/3273* (2013.01); *A47K 2201/02* (2013.01); *B05B 11/3052* (2013.01); *B05B 12/122* (2013.01)

(58) Field of Classification Search
USPC ..... 222/63, 333, 626, 630
See application file for complete search history.

(56) References Cited

U.S. PATENT DOCUMENTS 1,856,083 A 5/1932 Sather
3,187,949 A 6/1965 Mangel
3,228,347 A 1/1966 Corsette
3,237,571 A 3/1966 Corsette
3,379,136 A 4/1968 Corsette
3,495,571 A 2/1970 Evans
3,796,185 A 3/1974 Boone
3,802,606 A 4/1974 Gust
3,865,271 A 2/1975 Gold
3,910,229 A 10/1975 Spencer
4,144,987 A 3/1979 Kishi
4,274,560 A 6/1981 Cater
4,277,001 A 7/1981 Nozawa
4,389,003 A 6/1983 Meshberg
4,667,846 A 5/1987 Marceau
4,735,347 A 4/1988 Schultz et al.
4,798,312 A 1/1989 Scheiber
4,830,235 A 5/1989 Miller
4,882,875 A 11/1989 Green
5,277,559 A 1/1994 Schultz
5,312,021 A 5/1994 Nelson
5,417,258 A 5/1995 Privas
5,443,084 A 8/1995 Saleur
5,464,125 A 11/1995 Daansen
5,465,878 A 11/1995 Armijo et al.
5,492,247 A * 2/1996 Shu ..... A47K 5/1209 141/351
5,702,031 A 12/1997 Meshberg et al.
5,746,728 A 5/1998 Py
5,887,759 A 3/1999 Ayigbe
5,918,778 A 7/1999 Schultz
6,047,856 A 4/2000 Meshberg et al.
6,346,153 B1 2/2002 Lake et al.
6,401,977 B1 * 6/2002 Ross, III ..... B65D 35/285 222/100
6,409,093 B2 6/2002 Ulczynski et al.
6,415,962 B1 7/2002 Bougamont et al.
6,497,345 B1 12/2002 Wilker et al.
6,607,103 B2 8/2003 Gerenraich et al.
6,612,468 B2 9/2003 Pritchett et al.
6,820,821 B2 11/2004 Linstedt et al.
6,883,787 B2 4/2005 Allen
6,918,513 B1 7/2005 Downey
6,974,091 B2 12/2005 McLisky
7,101,441 B2 9/2006 Kennard
7,303,099 B2 12/2007 Ophardt
7,320,418 B2 1/2008 Sassoon
7,520,447 B2 4/2009 Engelen et al.
7,624,897 B2 12/2009 Bloc
7,641,077 B2 1/2010 Law et al.
7,669,735 B1 * 3/2010 Alleyne ..... B65D 35/245 222/102
7,681,765 B2 * 3/2010 Muderlak ..... A47K 5/16 222/1
7,708,166 B2 5/2010 Ophardt et al.
7,757,899 B2 7/2010 Van der Heijden
7,770,874 B2 8/2010 Ophardt et al.
7,775,458 B2 8/2010 Linstedt et al.
7,779,839 B2 8/2010 Pocock et al.
7,878,371 B2 2/2011 Sassoon
7,954,674 B2 6/2011 Roy et al.
8,002,150 B2 8/2011 Ophardt et al.
8,091,738 B2 1/2012 Ciavarella
8,261,941 B2 * 9/2012 Woo ..... A47K 5/1217 222/113
8,261,942 B2 * 9/2012 Chen ..... G01F 11/029 222/181.3
8,261,950 B2 9/2012 Cittadino et al.
8,272,540 B2 9/2012 Ophardt et al.
8,308,027 B2 11/2012 Law et al.
8,336,740 B1 12/2012 Daansen
8,342,363 B2 * 1/2013 Carpenter ..... A61L 9/14 222/52
8,365,965 B2 2/2013 Ophardt
8,371,479 B2 2/2013 Luft
8,418,889 B2 4/2013 Pritchett et al.
8,464,912 B2 6/2013 Ophardt et al.
8,474,664 B2 7/2013 Ophardt et al.
8,479,957 B2 7/2013 Ophardt
8,668,116 B2 3/2014 Ciavarella et al.
8,734,392 B2 5/2014 Stadelhofer
8,740,015 B2 6/2014 McLisky
8,746,504 B2 6/2014 Beland et al.
8,746,510 B2 6/2014 Cittadino et al.
8,777,062 B2 7/2014 Ciavarella
8,807,398 B2 8/2014 Sundberg et al.
8,870,030 B2 10/2014 Demarest et al.
8,881,945 B2 * 11/2014 Gasper ..... A01M 1/2038 222/1
8,899,449 B2 12/2014 Daansen
8,985,398 B2 3/2015 Demarest et al.
8,991,647 B2 3/2015 Meyers
9,061,821 B2 6/2015 Helf et al.
9,089,622 B2 7/2015 Helf et al.
9,132,954 B2 9/2015 Nilsson et al.
9,204,625 B2 12/2015 Furner
9,254,490 B2 2/2016 Daansen
9,375,745 B2 6/2016 Finch
9,394,096 B2 7/2016 Betts et al.
9,428,898 B1 8/2016 Clements
9,456,718 B1 10/2016 Myatt
D773,849 S 12/2016 Criswell et al.
9,527,656 B2 12/2016 Walters et al.
9,532,684 B2 1/2017 Hoefte et al.
9,649,400 B2 5/2017 Furner et al.
9,694,199 B2 7/2017 Duquet et al.
2003/0052136 A1 3/2003 Weng
2005/0039293 A1 2/2005 McReynolds et al.
2005/0183194 A1 8/2005 Haile, Jr.
2006/0049208 A1 3/2006 Daansen
2007/0034149 A1 2/2007 Gonzalez Escobar
2007/0051742 A1 3/2007 Qiu
2008/0290113 A1 11/2008 Helf et al.
2008/0290120 A1 11/2008 Helf et al.
2009/0090737 A1 4/2009 Franco
2010/0288851 A1 11/2010 Davies
2013/0112715 A1 5/2013 Ophardt
2014/0135245 A1 5/2014 Annaheim et al.
2014/0224893 A1 8/2014 Finch
2014/0252042 A1 9/2014 Cittadino
2015/0125343 A1 5/2015 Hall
2016/0121350 A1 5/2016 Yeung
2016/0131267 A1 5/2016 Daansen
2016/0193618 A1 7/2016 Sacchet
2016/0256020 A1 9/2016 Yasui
2016/0280422 A1 9/2016 Dorrance
2016/0309969 A1 10/2016 Brants
2016/0362051 A1 12/2016 Clair-Chalupka
2017/0164793 A1 6/2017 Staub
2017/0251884 A1 9/2017 Carignan et al.

(56) References Cited

U.S. PATENT DOCUMENTS

| | | | |
|---|---|---|---|
| 2017/0259292 | A1 | 9/2017 | Choi et al. |
| 2017/0354984 | A1 | 12/2017 | Beal |
| 2018/0106431 | A1 | 4/2018 | Timm et al. |

FOREIGN PATENT DOCUMENTS

| | | |
|---|---|---|
| DE | 202013000668 | 3/2013 |
| FR | 2848590 | 6/2004 |
| GB | 618311 | 2/1949 |
| WO | 01/41614 | 6/2001 |
| WO | 2011/083401 | 7/2011 |
| WO | 2016/094969 | 6/2016 |
| WO | 2016/124059 | 8/2016 |
| WO | 2016/152881 | 9/2016 |
| WO | 2016/162660 | 10/2016 |
| WO | 2016/169632 | 10/2016 |
| WO | 2017/025707 | 2/2017 |

* cited by examiner

AUTOMATED FLOWABLE MATERIAL DISPENSERS AND RELATED METHODS FOR DISPENSING FLOWABLE MATERIAL

CROSS-REFERENCE TO RELATED APPLICATIONS

This application claims the benefit of U.S. Provisional Application No. 62/490,009, filed on Apr. 25, 2017, which is incorporated by reference herein in its entirety.

FIELD OF THE DISCLOSURE

The present disclosure relates generally to product dispensers and more particularly to automated flowable material dispensers and related methods for dispensing flowable material from a dispenser.

BACKGROUND

Various types of product dispensers are known in the art, including mechanical and automated dispensers configured to dispense a product from a supply of product supported by the dispenser. For example, flowable material dispensers may be configured to allow a user to obtain a particular type of flowable material, such as a cleansing liquid, gel, or foam; a sanitizer liquid, gel, or foam; an antimicrobial liquid, gel, or foam; a liquid, gel, or foam lotion; a liquid, gel, or foam soap; or a liquid, gel, or foam detergent, from a supply of flowable material supported by the dispenser. The supply of flowable material may be provided in a container for storing the flowable material prior to dispensing from the dispenser. The container may be refilled upon depletion of the supply of flowable material, or the container may be replaced with a new prefilled container upon depletion of the supply of flowable material in the original container. Flowable material dispensers generally may be configured to dispense flowable material in a downward direction onto a user's hand or onto a substrate, such as a sheet product, held by the user's hand.

Automated flowable material dispensers generally may be configured to automatically dispense flowable material for a user upon user actuation of the dispenser or upon the dispenser sensing the presence of a user. Automated flowable material dispensers may include an automated dispensing mechanism configured to move a portion of the flowable material from the container to a dispensing nozzle during each dispense cycle. According to various configurations, the automated dispensing mechanism may include a motor, a drivetrain, a pump, a tube, and/or other components configured to move the flowable material from the container to the dispensing nozzle.

Although existing automated flowable material dispensers may be suitable for dispensing certain flowable materials in some applications, such dispensers may present one or more problems in other applications. First, the automated dispensing mechanism of certain dispensers may be relatively complex and may include numerous components for moving the flowable material from the container to the dispensing nozzle, and such components, particularly pumps, may be prone to wear, degradation, or failure over time. Second, the automated dispensing mechanism of certain dispensers may not be able to ensure that a relatively consistent amount of the flowable material is dispensed during each dispense cycle, which may negatively affect user experience as well as user perception of the dispenser. Third, the automated dispensing mechanism of certain dispensers may not be able to dispense the entire supply of flowable material from the container, which may result in waste of the remaining flowable material when the container is replaced with a new prefilled container. Fourth, the dispensing nozzle of certain dispensers may not adequately control the dispensing pattern of the flowable material, which may be frustrating for a user who desires to have the flowable material evenly applied to a substrate, such as a sheet product. Fifth, with certain dispensers, the process of refilling a depleted container with flowable material or replacing a depleted container with a new prefilled container may be cumbersome and time-consuming, and an improperly installed container may inhibit operation of the automated dispensing mechanism.

There is thus a desire for improved automated flowable material dispensers and related methods for dispensing flowable material therewith. Such dispensers may include an automated dispensing mechanism having a robust and relatively simple configuration that includes a limited number of components for moving the flowable material from a container to a dispensing nozzle. Additionally, the automated dispensing mechanism may ensure that a relatively consistent amount of the flowable material is dispensed during each dispense cycle and may be able to dispense the entire, or substantially the entire, supply of flowable material from the container. Such dispensers also may include a dispensing nozzle that controls the dispensing pattern of the flowable material such that the flowable material may be evenly applied to a substrate, such as a sheet product. Furthermore, such dispensers may allow a depleted container to be quickly and easily replaced with a new prefilled container and also may ensure that the container is properly installed to allow desired operation of the automated dispensing mechanism.

SUMMARY

In one aspect, an automated flowable material dispenser for dispensing flowable material from a flowable material container is provided. According to one embodiment, the automated flowable material dispenser may include a dispenser housing and a motor assembly. The dispenser housing may include a dispensing opening and be configured to receive the flowable material container therein. The motor assembly may be positioned within the dispenser housing and configured to translate with respect to the dispenser housing between a home position and a dispensing position to dispense the flowable material from the flowable material container. The motor assembly may include a motor housing and a motor positioned at least partially within the motor housing.

In another aspect, a method of dispensing flowable material from a flowable material container using an automated flowable material dispenser is provided. According to one embodiment, the method may include the steps of receiving the flowable material container within a dispenser housing of the dispenser, and translating a motor assembly of the dispenser with respect to the dispenser housing between a home position and a dispensing position to dispense the flowable material from the flowable material container. The motor assembly may be positioned within the dispenser housing, and the motor assembly may include a motor housing and a motor positioned at least partially within the motor housing.

In still another aspect, an automated flowable material dispenser system for dispensing flowable material is provided. According to one embodiment, the automated flowable material dispenser system may include an automated flowable material dispenser and a flowable material container. The automated flowable material dispenser may include a dispenser housing and a motor assembly. The dispenser housing may include a dispensing opening. The motor assembly may be positioned within the dispenser housing and configured to translate with respect to the dispenser housing between a home position and a dispensing position. The motor assembly may include a motor housing and a motor positioned at least partially within the motor housing. The flowable material container may be positioned within the dispenser housing and may contain a flowable material therein. The motor assembly may be configured to dispense the flowable material from the flowable material container when the motor assembly translates with respect to the dispenser housing between the home position and the dispensing position.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1A:
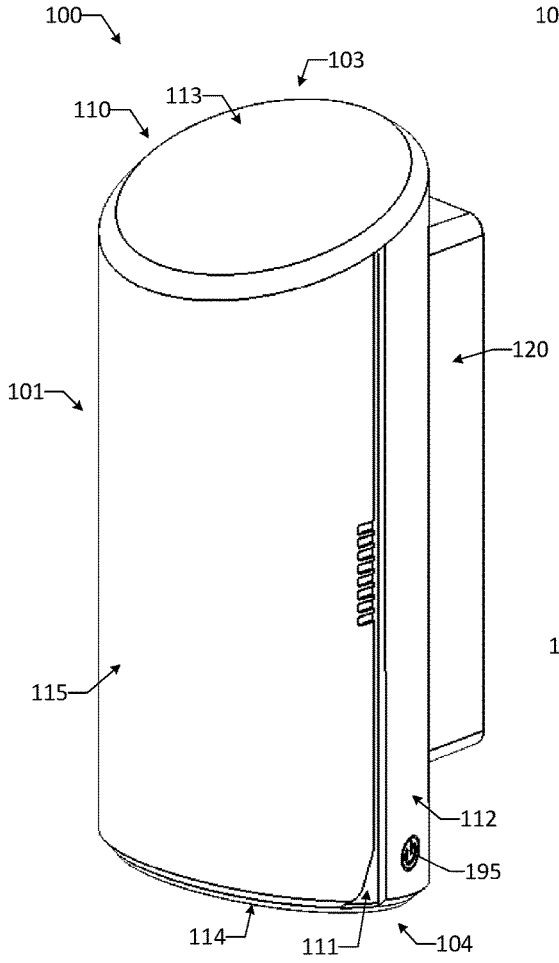
FIG. 1A is a front perspective view of an automated flowable material dispenser in accordance with one or more embodiments of the disclosure, showing a housing and a mounting bracket of the dispenser.
Figure 1B:
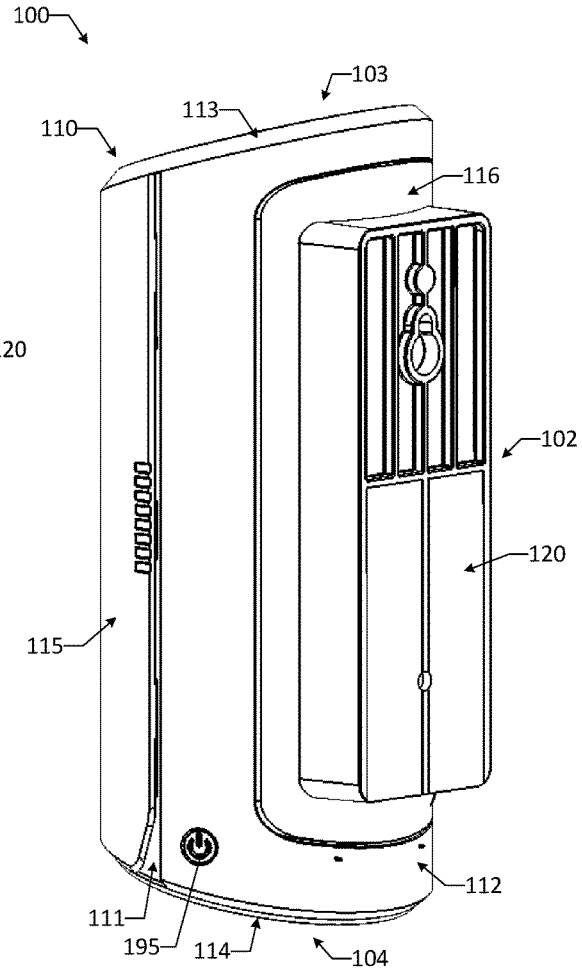
FIG. 1B is a back perspective view of the automated flowable material dispenser of FIG. 1A.
Figure 1C:
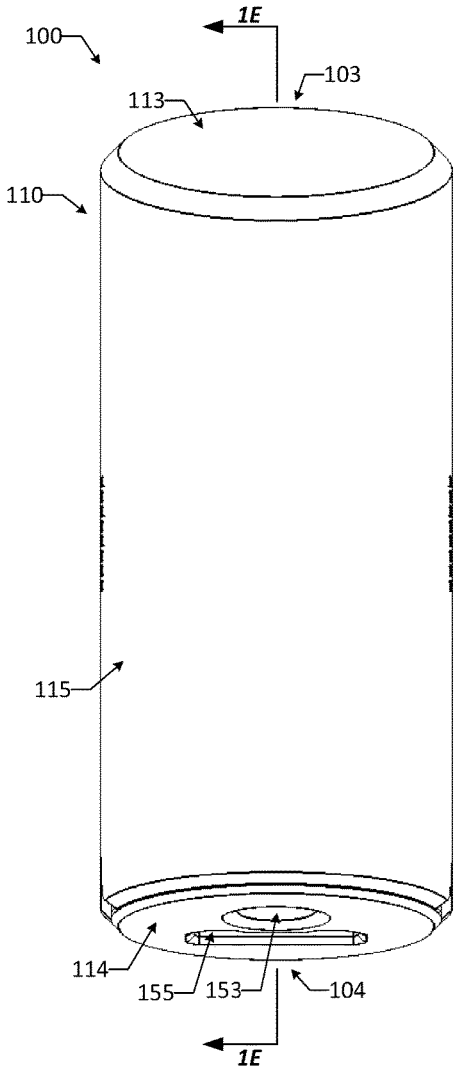
FIG. 1C is a front view of the automated flowable material dispenser of FIG. 1A.
Figure 1D:
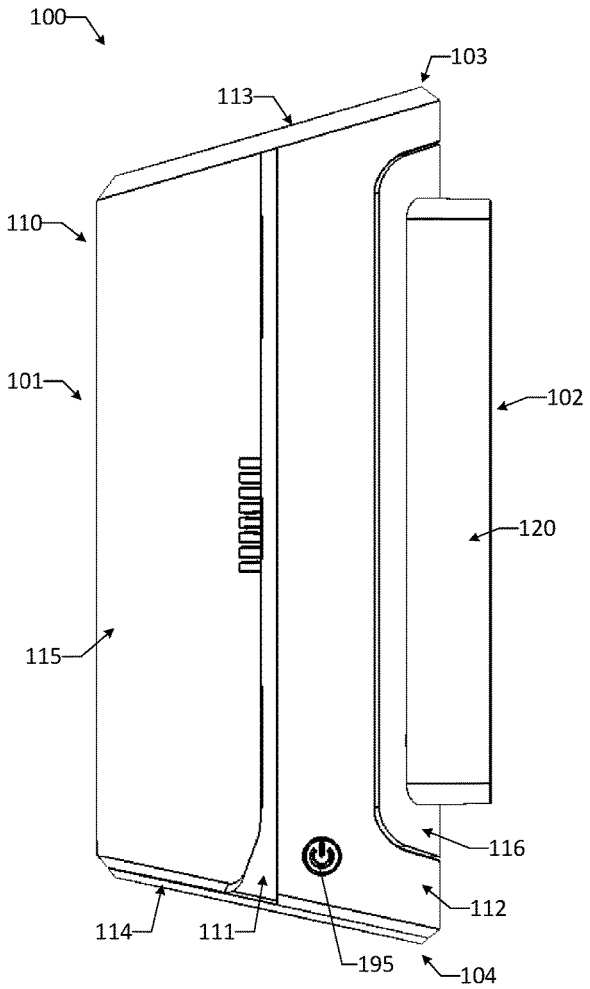
FIG. 1D is a side view of the automated flowable material dispenser of FIG. 1A.
Figure 1E:
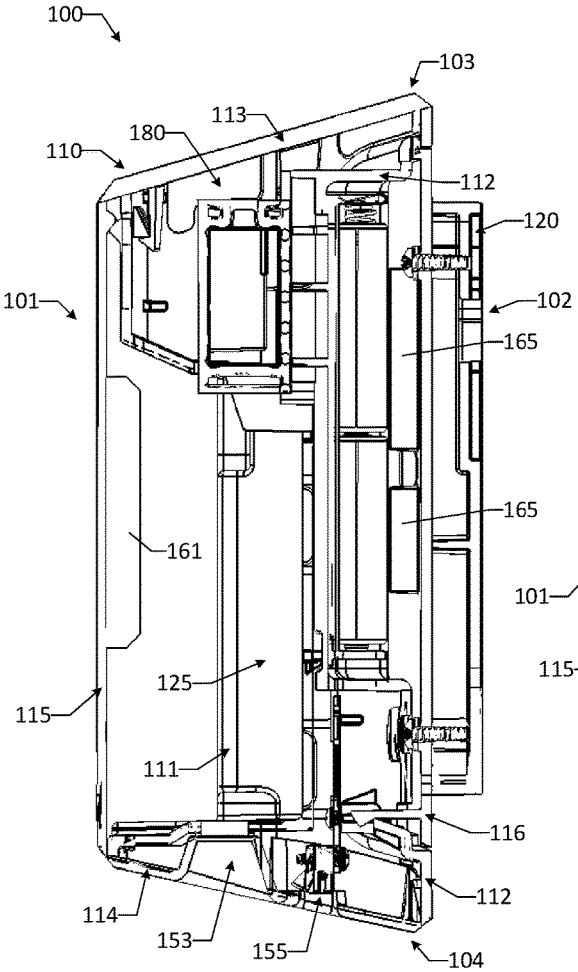
FIG. 1E is a cross-sectional side view of the automated flowable material dispenser of FIG. 1A, taken along line 1E-1E of FIG. 1C.
Figure 1F:
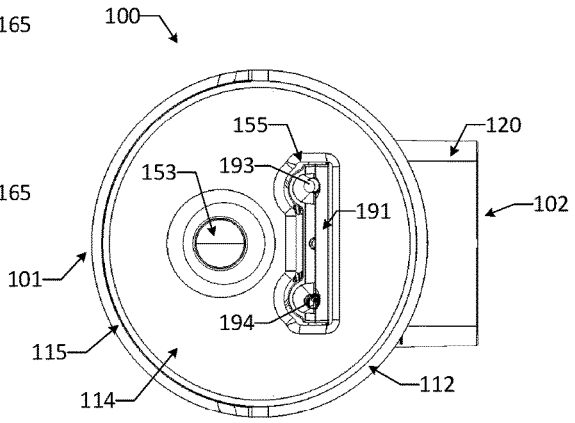
FIG. 1F is a bottom view of the automated flowable material dispenser of FIG. 1A.
Figure 1G:
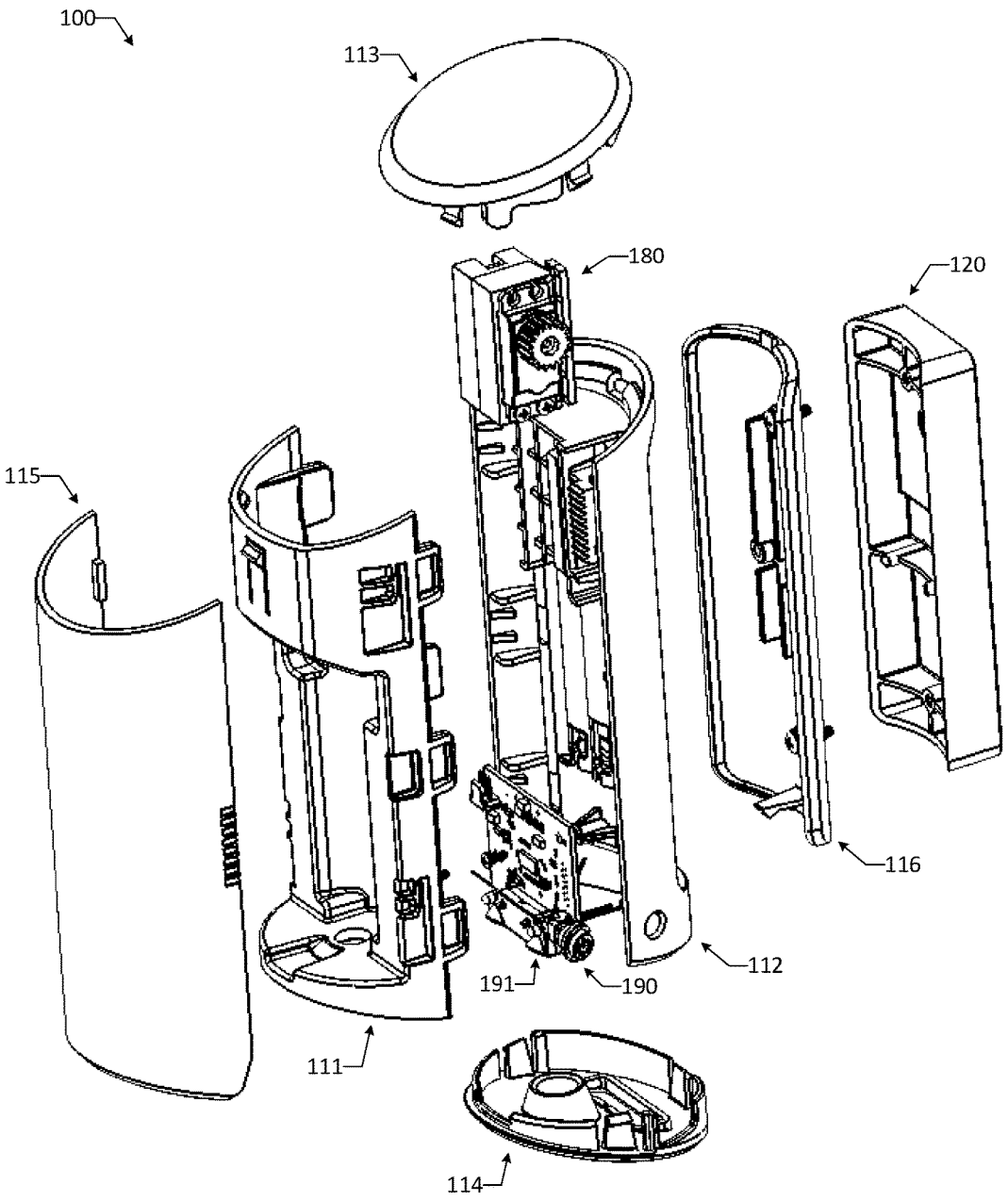
FIG. 1G is an exploded perspective view of the automated flowable material dispenser of FIG. 1A.

The automated flowable material dispensers and related methods provided herein advantageously utilize an automated dispensing mechanism having a robust and relatively simple configuration that includes a limited number of components for dispensing flowable material from a replaceable flowable material container. As described in detail below, the flowable material container may include a reservoir for containing the flowable material therein, a pump for moving the flowable material out of the reservoir, and a nozzle cap for actuating the pump and dispensing the flowable material from the container. The automated flowable material dispensers may include a housing for receiving the flowable material container therein, and a motor assembly for moving the container between a relaxed configuration and an actuated configuration. As described below, the flowable material container may be received within the housing in an inverted orientation, and the motor assembly may move the reservoir relative to the housing while the nozzle cap remains stationary when the container is moved between the relaxed configuration and the actuated configuration to dispense the flowable material. The automated flowable material dispensers and the flowable material container advantageously may ensure that a substantially consistent amount of the flowable material is dispensed during each dispense cycle and may be able to dispense the entire, or substantially the entire, supply of flowable material from the container. The automated flowable material dispensers and the flowable material container also may control the dispensing pattern of the flowable material such that the flowable material may be evenly applied to a substrate, such as a sheet product. As described below, the automated flowable material dispensers may be associated with a sheet product dispenser, such that a user may dispense a portion of sheet product and then dispense an amount of the flowable material onto the sheet product for subsequent use. Furthermore, the automated flowable material dispensers and the flowable material container may allow a depleted container to be quickly and easily replaced with a new prefilled container and also may ensure that the container is properly installed to allow desired operation of the automated dispensing mechanism.

The present disclosure includes non-limiting embodiments of automated flowable material dispensers, flowable material containers, and related methods for dispensing flowable material. The embodiments are described in detail herein to enable one of ordinary skill in the art to practice the automated flowable material dispensers, flowable material containers, and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "flowable material" refers to any material, such as a liquid, gel, or foam material, that is able to move or be moved along in a flow. Examples of flowable materials include, but are not limited to, soap, sanitizer, cleanser, air freshener, shampoo, body wash, lotion, or other skincare or personal hygiene products, condiments or other foodservice products, or cleaning products, whether in the form of a liquid, gel, foam, or combinations thereof. In some embodiments, the flowable material may be stored in one form, such as a liquid, and dispensed in the same form. In some embodiments, the flowable material may be stored in one form, such as a liquid, and dispensed in another form, such as a foam.

As used herein, the term "sheet product" refers to a product that is relatively thin in comparison to its length and width and exhibits a relatively flat, planar configuration, yet is flexible or bendable to permit folding, rolling, stacking, or the like. Example sheet products include towel, bath tissue, facial tissue, napkin, wipe, or other sheet-like products. Sheet products may be made from paper, cloth, non-woven, metallic, polymer or other materials, and in some cases may include multiple layers or plies. In some embodiments, the sheet product may be continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing.

As used herein, the term "substantially rigid," as used with respect to a component or an assembly, means that the component or the assembly does not deform during its normal intended use as described herein.

The meanings of other terms used herein will be apparent to one of ordinary skill in the art or will become apparent to one of ordinary skill in the art upon review of the detailed description when taken in conjunction with the several drawings and the appended claims.

Figure 1H:
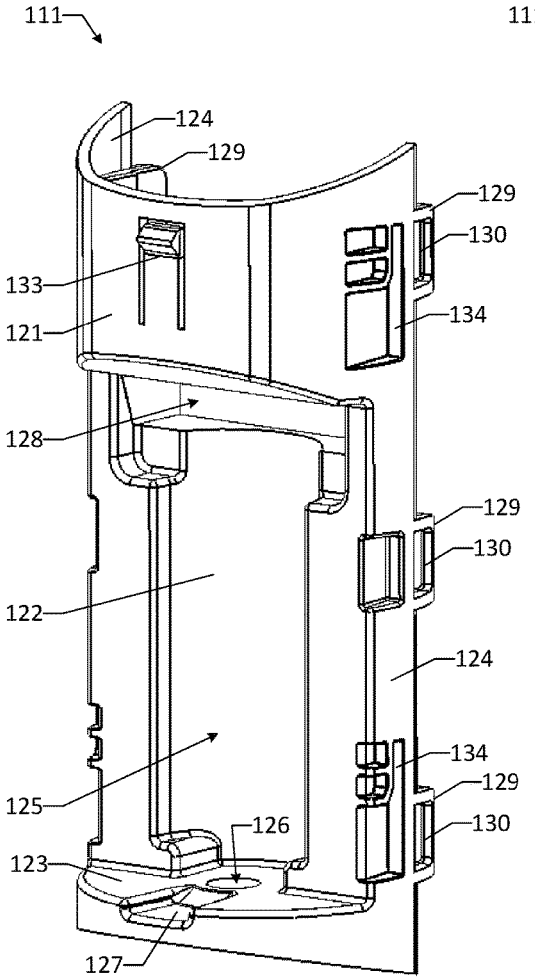
FIG. 1H is a front perspective view of a first housing portion of the housing of the automated flowable material dispenser of FIG. 1A.
Figure 1I:
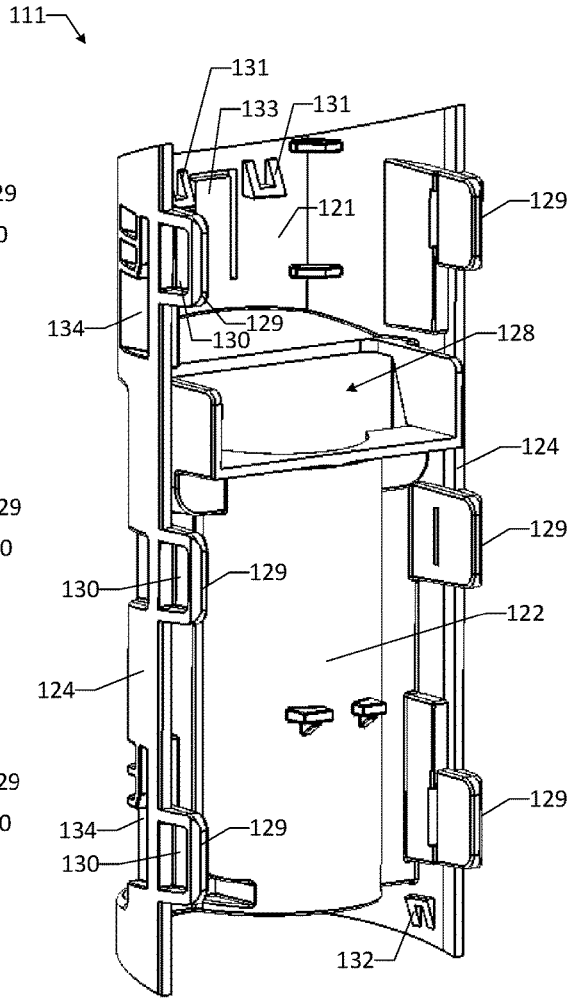
FIG. 1I is a back perspective view of the first housing portion of the automated flowable material dispenser of FIG. 1A.
Figure 1J:
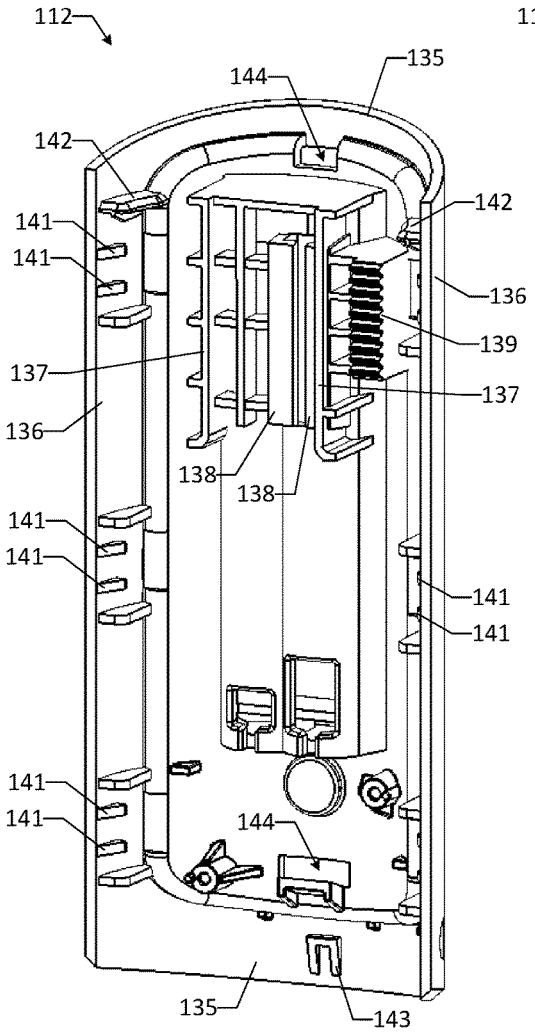
FIG. 1J is a front perspective view of a second housing portion of the housing of the automated flowable material dispenser of FIG. 1A.
Figure 1K:
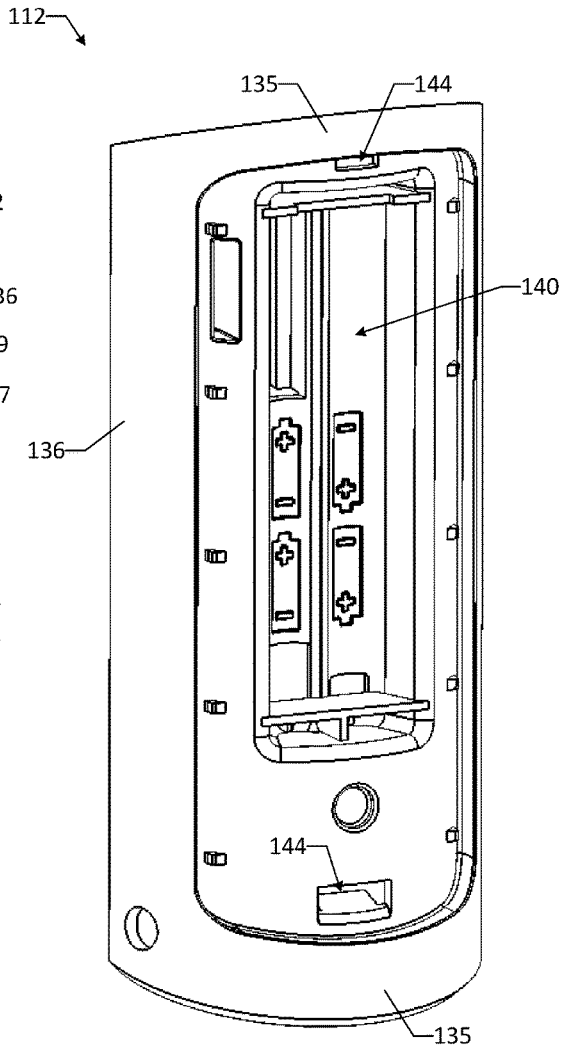
FIG. 1K is a back perspective view of the second housing portion of the automated flowable material dispenser of FIG. 1A.
Figure 1L:
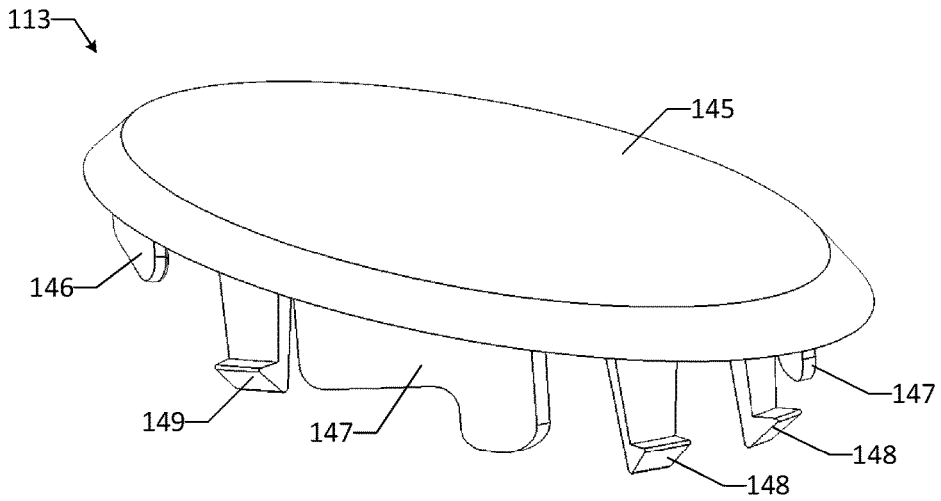
FIG. 1L is a top perspective view of a third housing portion of the housing of the automated flowable material dispenser of FIG. 1A.
Figure 1M:
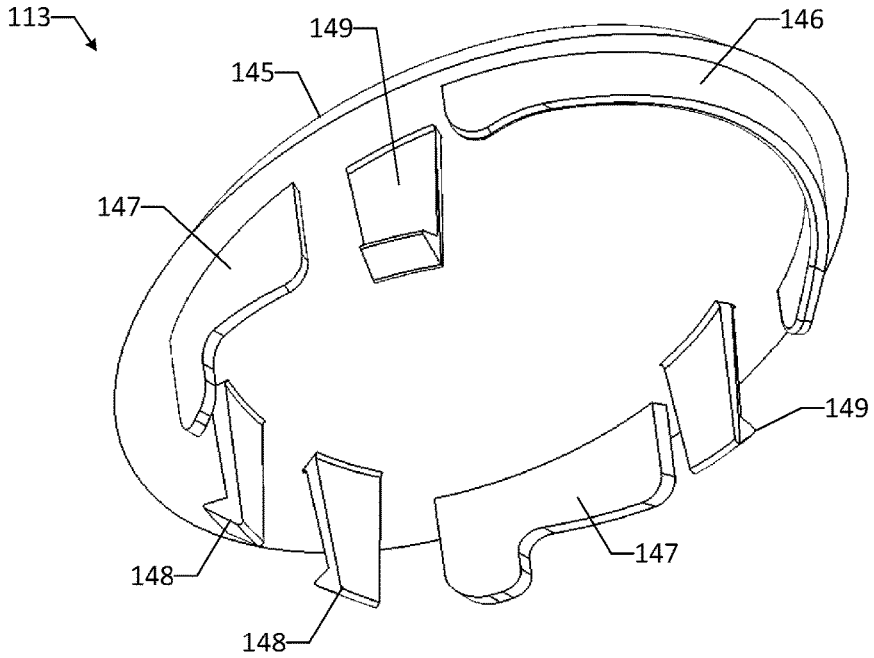
FIG. 1M is a bottom perspective view of the third housing portion of the automated flowable material dispenser of FIG. 1A.
Figure 1N:
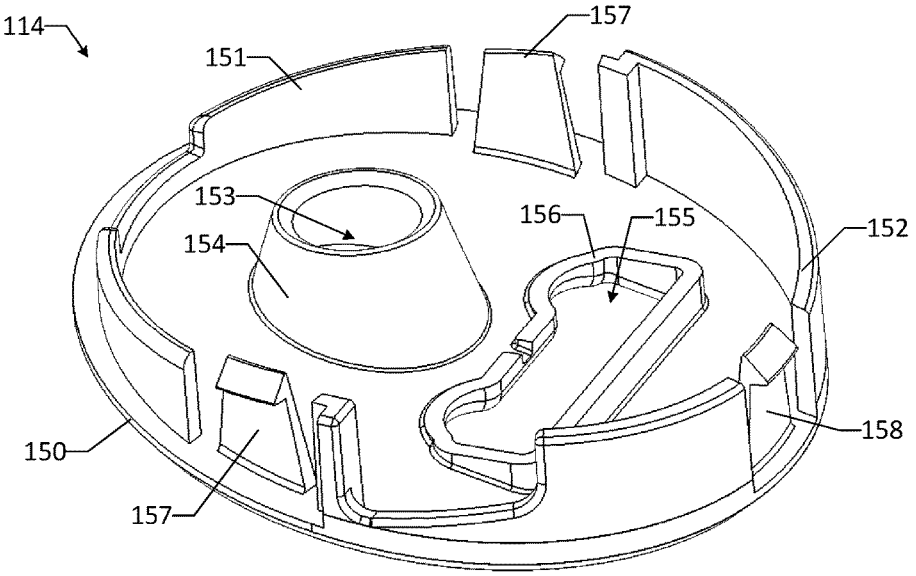
FIG. 1N is a top perspective view of a fourth housing portion of the housing of the automated flowable material dispenser of FIG. 1A.
Figure 1O:
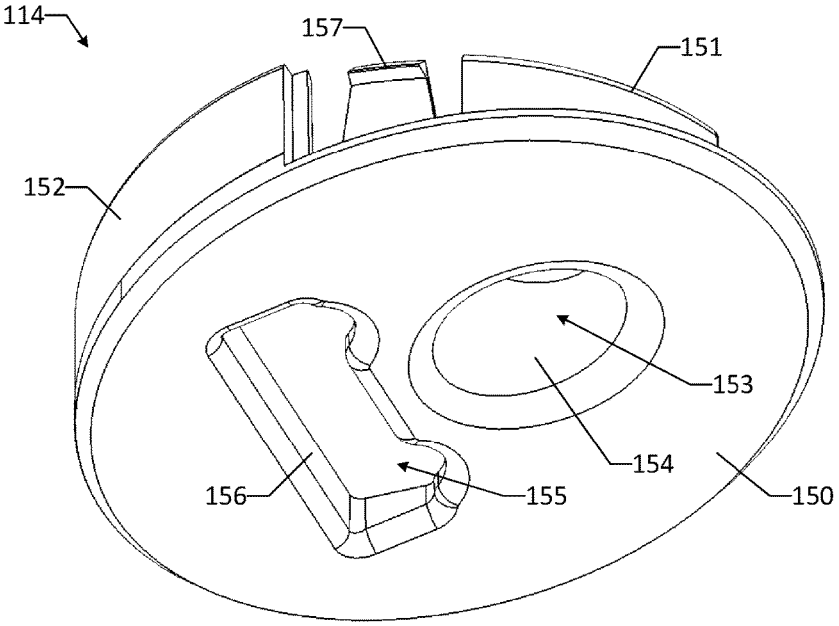
FIG. 1O is a bottom perspective view of the fourth housing portion of the automated flowable material dispenser of FIG. 1A.
Figure 1P:
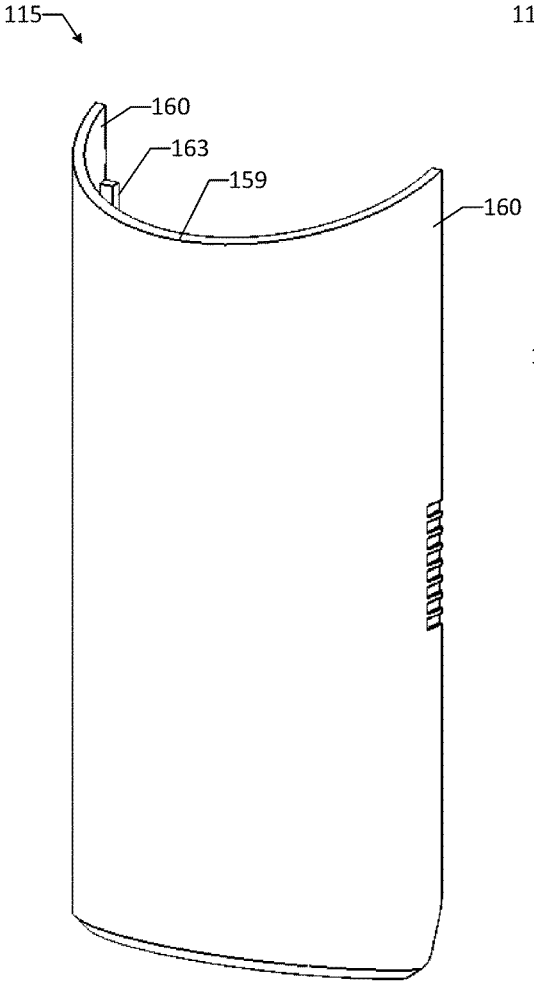
FIG. 1P is a front perspective view of a fifth housing portion of the housing of the automated flowable material dispenser of FIG. 1A.
Figure 1Q:
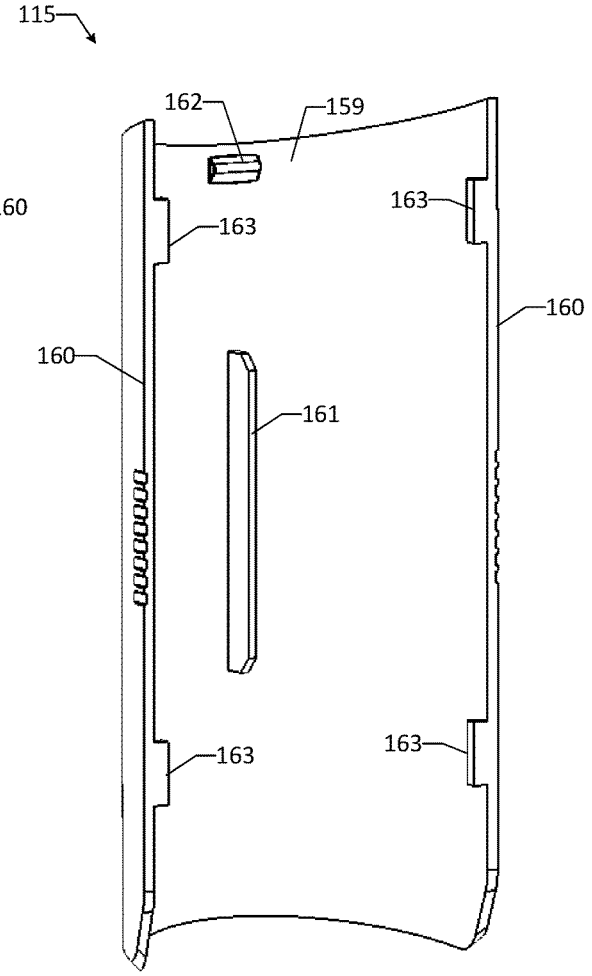
FIG. 1Q is a back perspective view of the fifth housing portion of the automated flowable material dispenser of FIG. 1A.
Figure 1R:
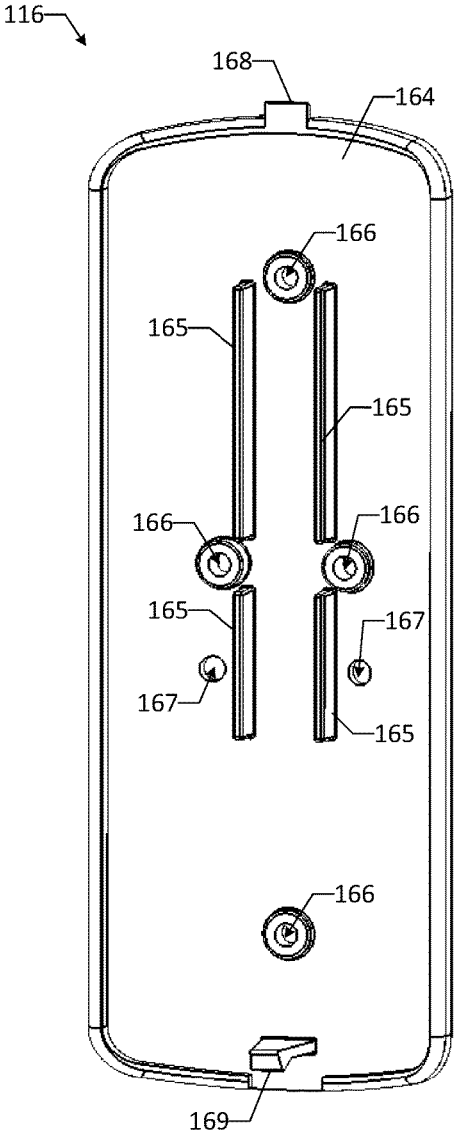
FIG. 1R is a front perspective view of a sixth housing portion of the housing of the automated flowable material dispenser of FIG. 1A.
Figure 1S:
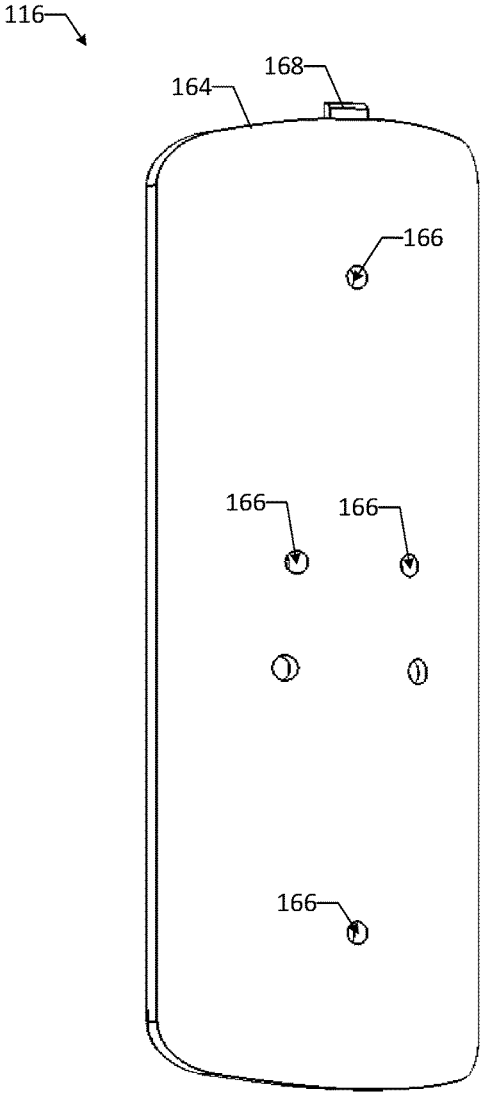
FIG. 1S is a back perspective view of the sixth housing portion of the automated flowable material dispenser of FIG. 1A.
Figure 1T:
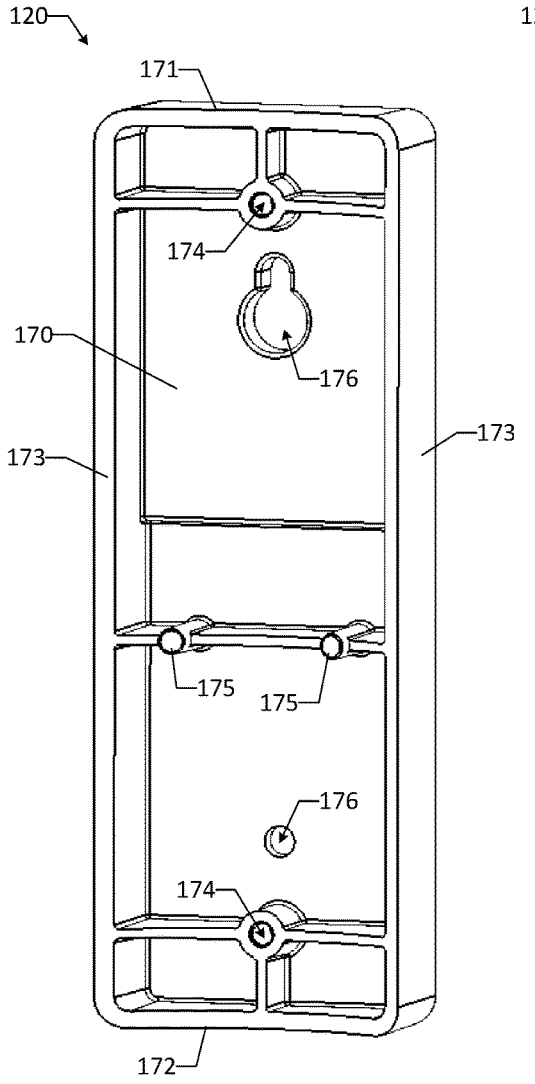
FIG. 1T is a front perspective view of the mounting bracket of the automated flowable material dispenser of FIG. 1A.
Figure 1U:
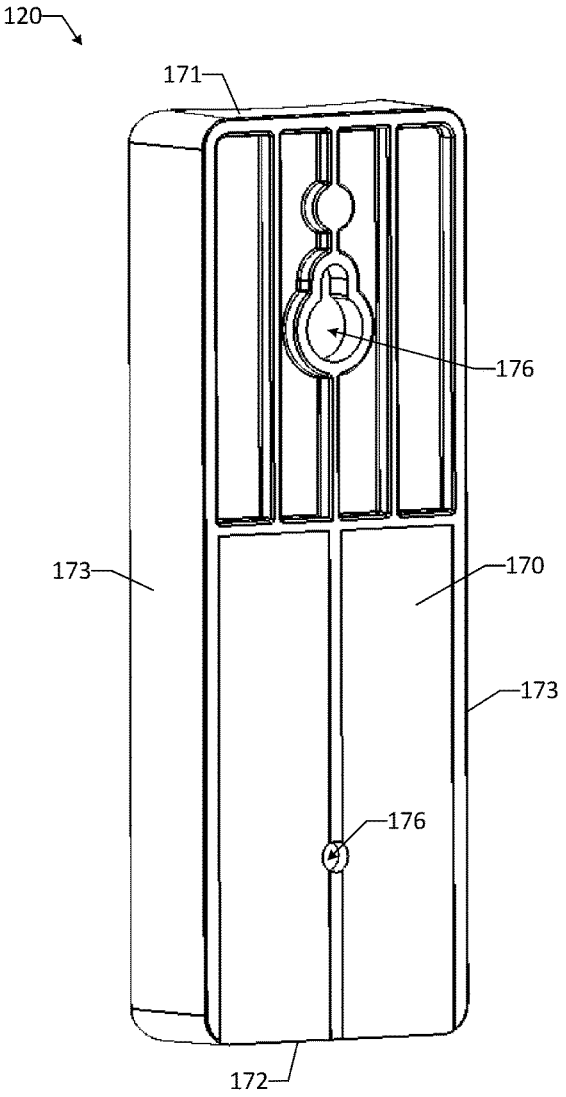
FIG. 1U is a back perspective view of the mounting bracket of the automated flowable material dispenser of FIG. 1A.
Figure 1V:
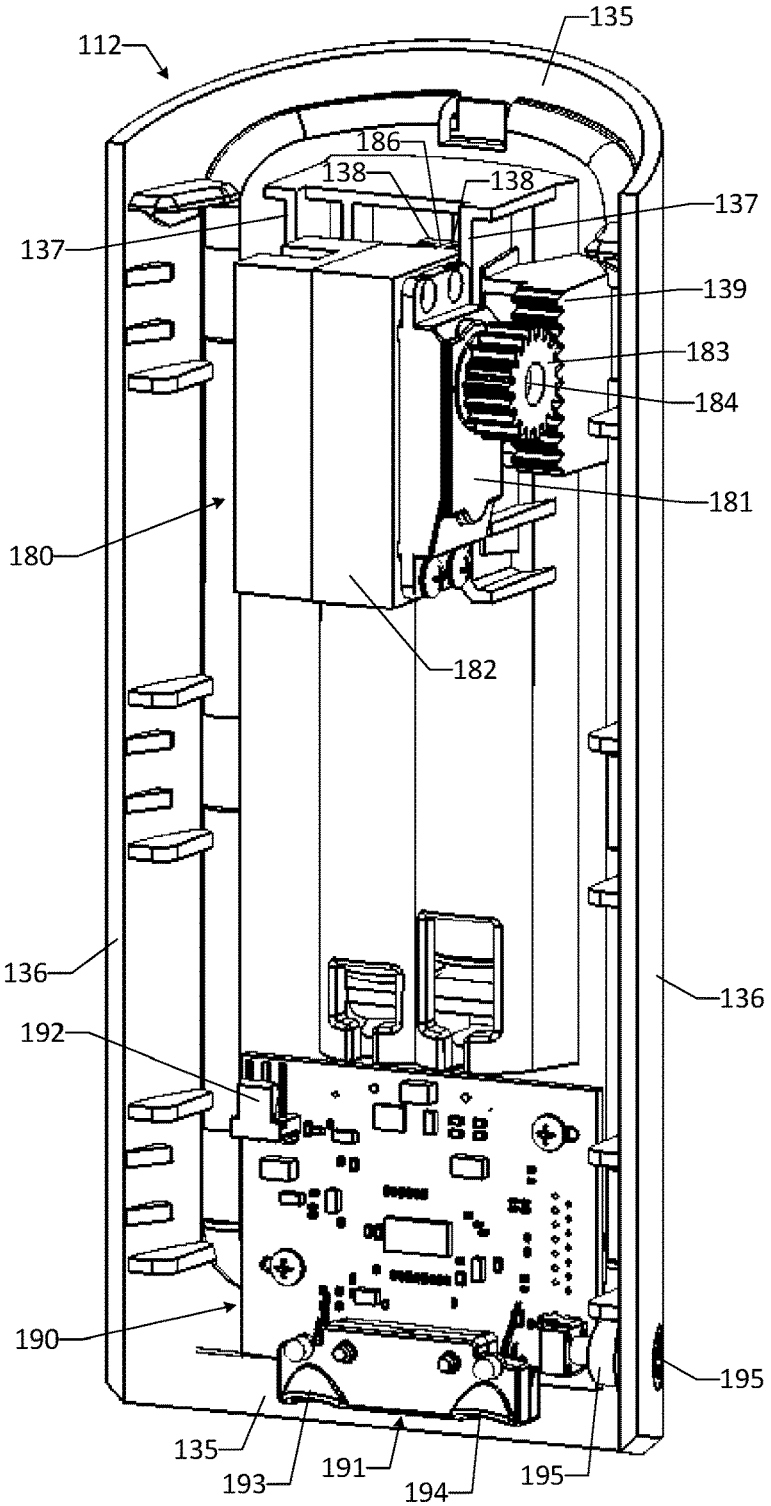
FIG. 1V is a front perspective view of a portion of the automated flowable material dispenser of FIG. 1A, showing the second housing portion, a motor assembly, an electronics module, and a sensor module of the dispenser.
Figure 1W:
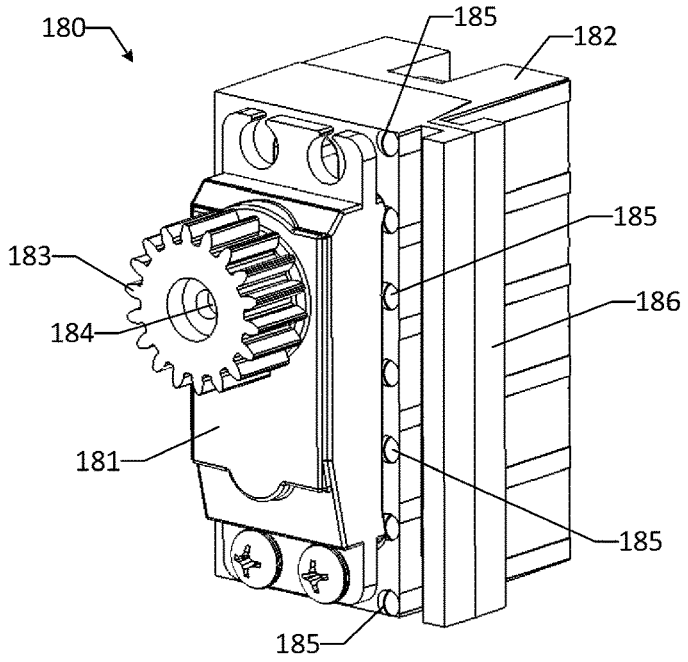
FIG. 1W is a back perspective view of the motor assembly of the automated flowable material dispenser of FIG. 1A.
Figure 1X:
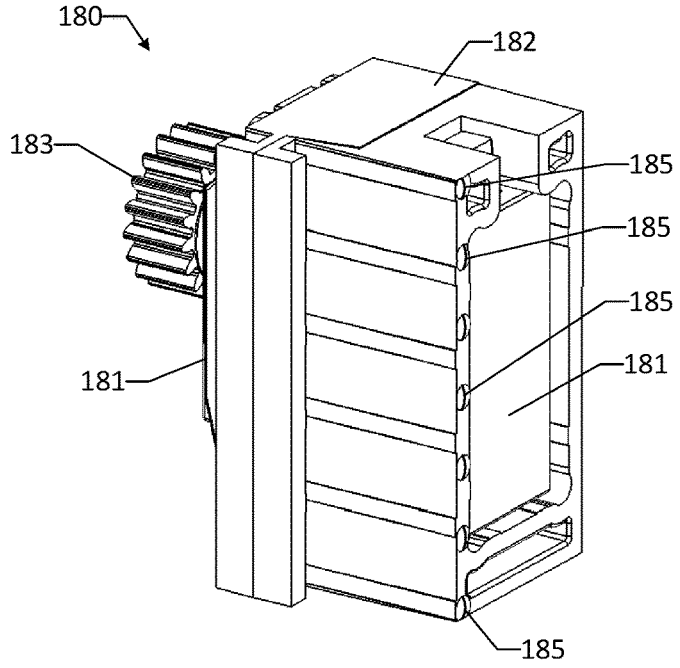
FIG. 1X is a back perspective view of the motor assembly of the automated flowable material dispenser of FIG. 1A.
Figure 2A:
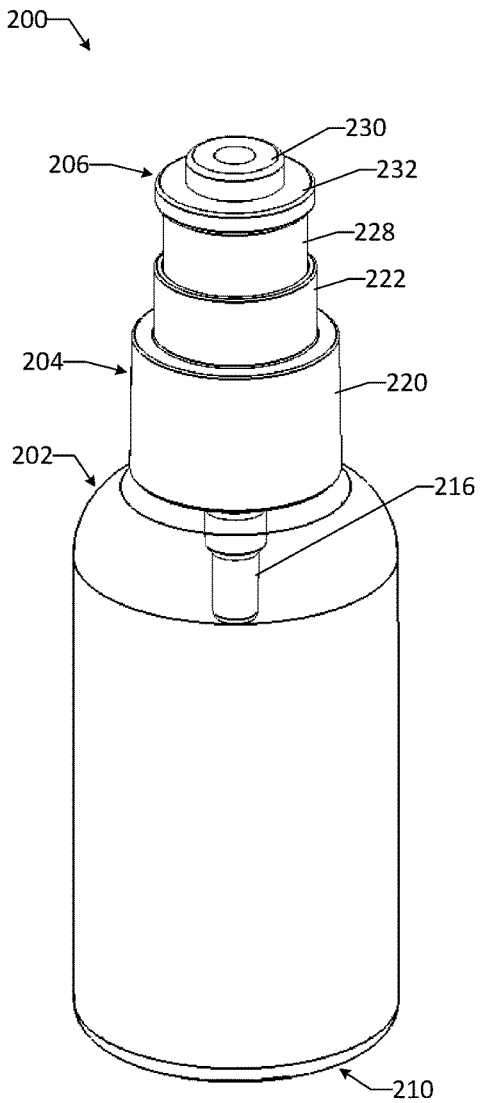
FIG. 2A is a front perspective view of a flowable material container in accordance with one or more embodiments of the disclosure, showing a reservoir, a pump, and a nozzle cap of the container.
Figure 2B:
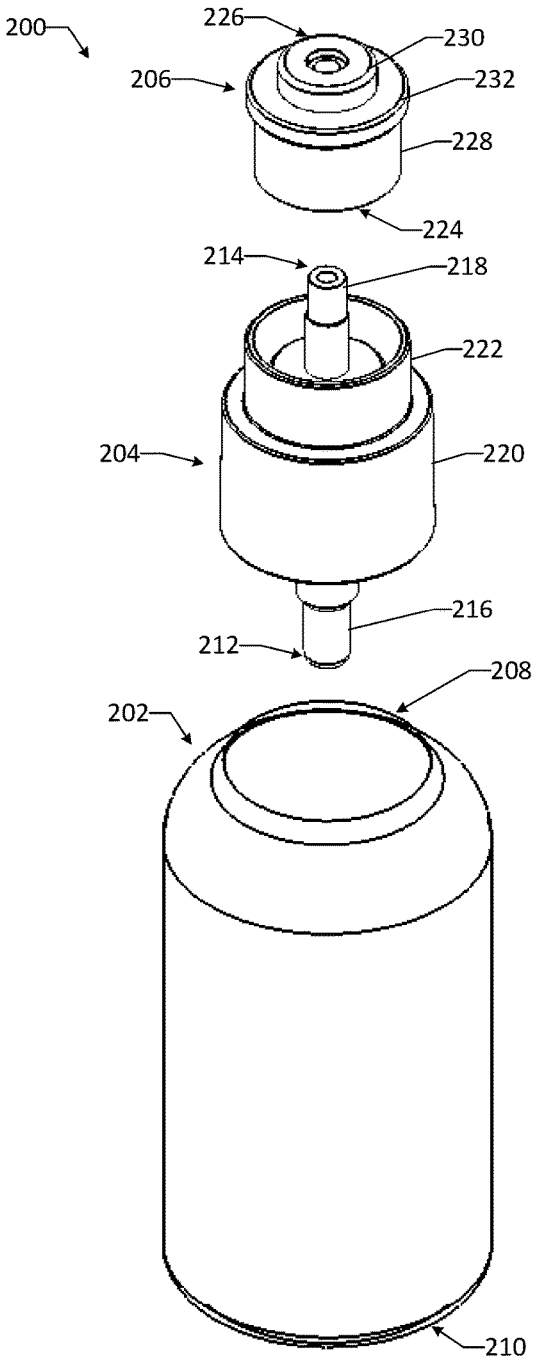
FIG. 2B is an exploded perspective view of the flowable material container of FIG. 2A.
Figure 2C:
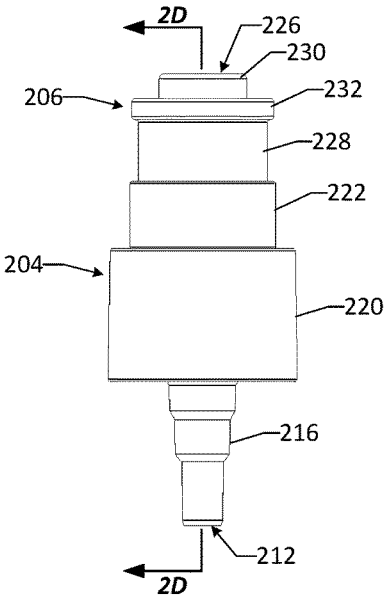
FIG. 2C is a front view of the pump and the nozzle cap of the flowable material container of FIG. 2A.
Figure 2D:
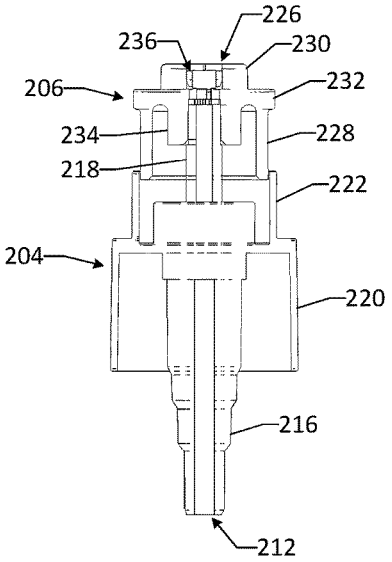
FIG. 2D is a cross-sectional side view of the pump and the nozzle cap of the flowable material container of FIG. 2A, taken along line 2D-2D of FIG. 2C.
Figure 2E:
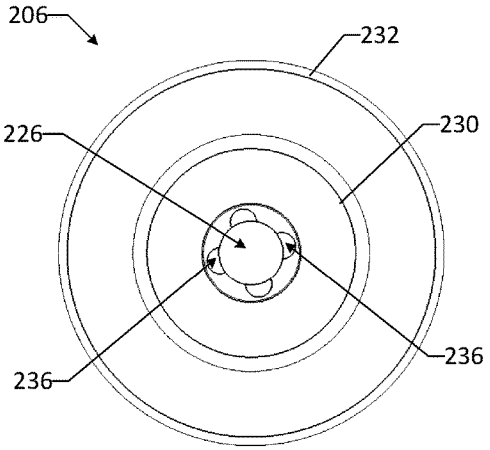
FIG. 2E is an end view of the nozzle cap of the flowable material container of FIG. 2A.
Figure 2F:
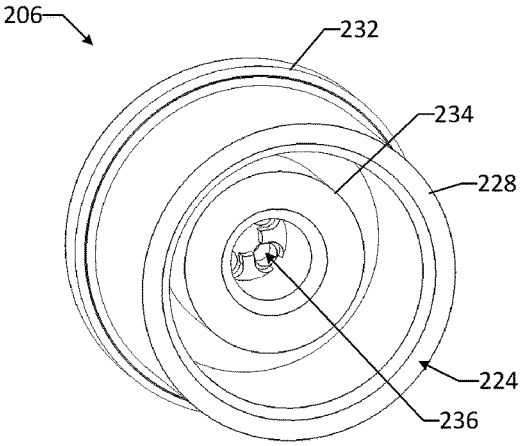
FIG. 2F is an end perspective view of the nozzle cap of the flowable material container of FIG. 2A.
Figure 2G:
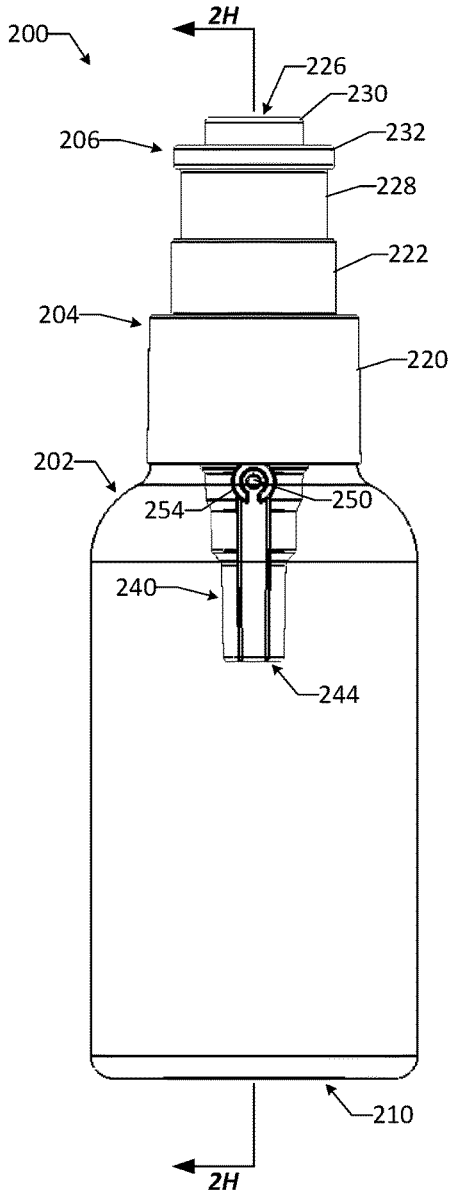
FIG. 2G is a front view of the flowable material container of FIG. 2A in accordance with one or more embodiments of the disclosure, showing the reservoir, the pump, the nozzle cap, and a siphon tube of the container.
Figure 2H:
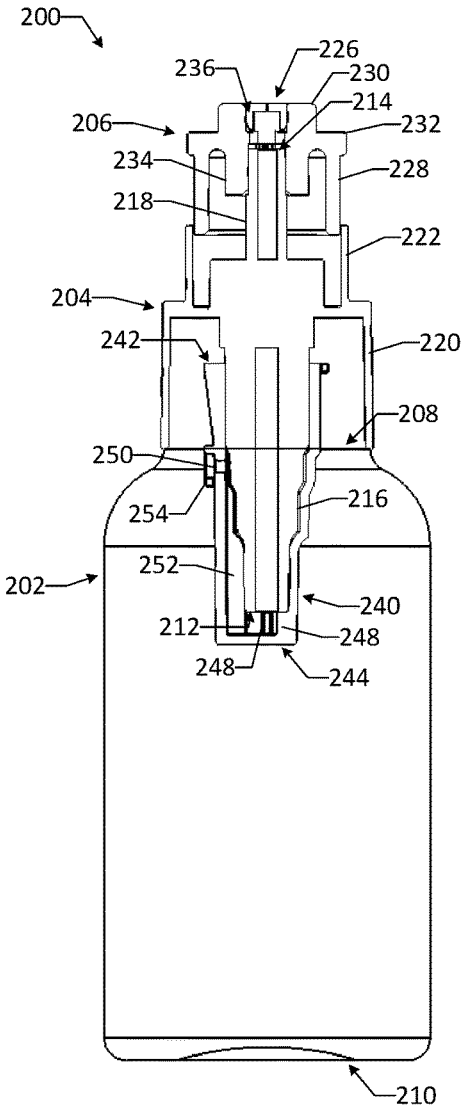
FIG. 2H is a cross-sectional side view of the flowable material container of FIG. 2G, taken along line 2H-2H of FIG. 2G.
Figure 2I:
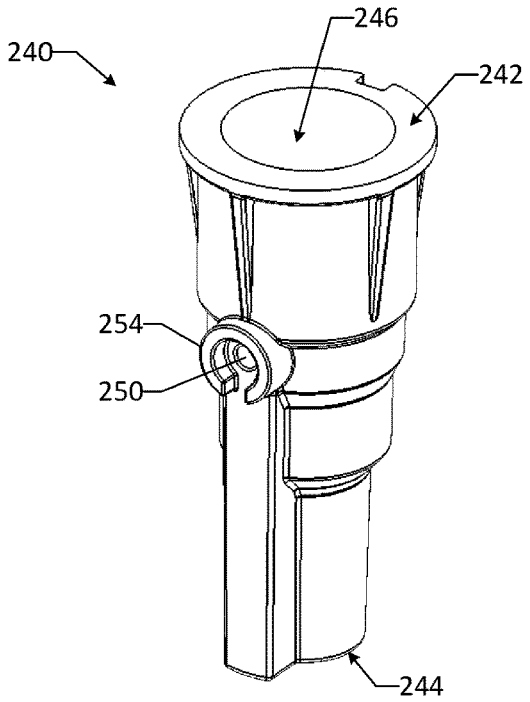
FIG. 2I is a top perspective view of the siphon tube of the flowable material container of FIG. 2G.
Figure 2J:
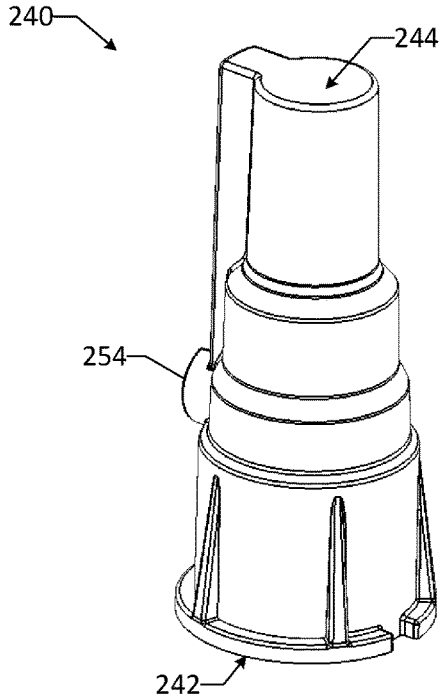
FIG. 2J is a bottom perspective view of the siphon tube of the flowable material container of FIG. 2G.
Figure 2K:
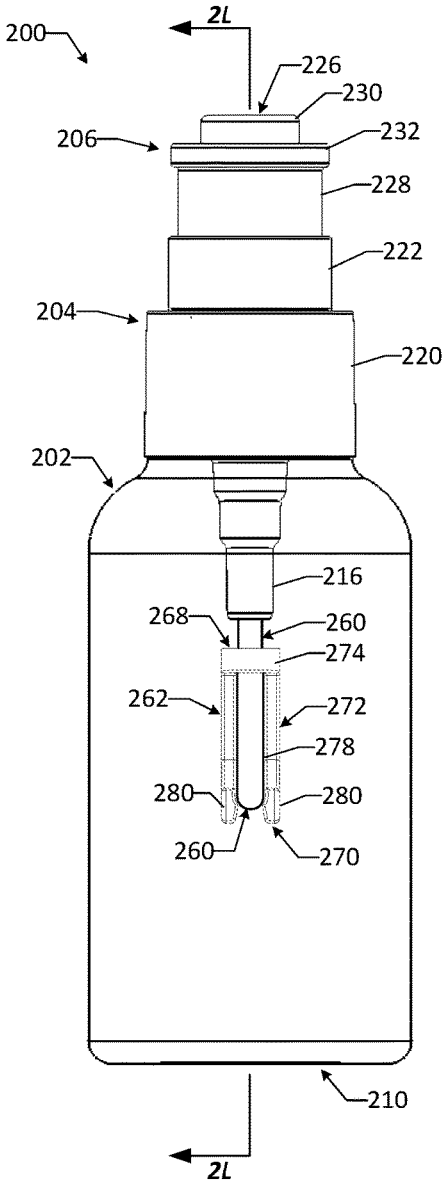
FIG. 2K is a front view of the flowable material container of FIG. 2A in accordance with one or more embodiments of the disclosure, showing the reservoir, the pump, the nozzle cap, a dip tube, and a clip of the container.
Figure 2L:
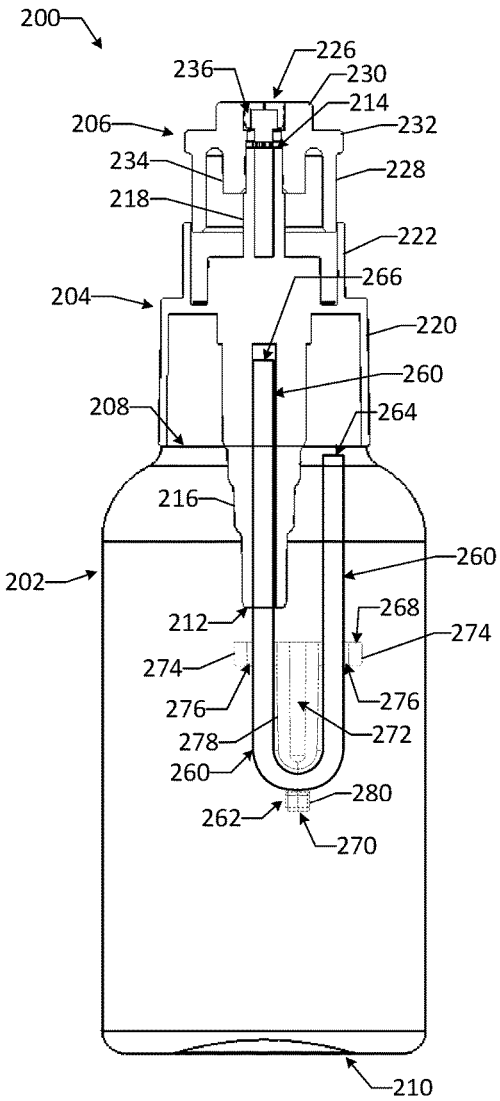
FIG. 2L is a cross-sectional side view of the flowable material container of FIG. 2K, taken along line 2L-2L of FIG. 2K.
Figure 2M:
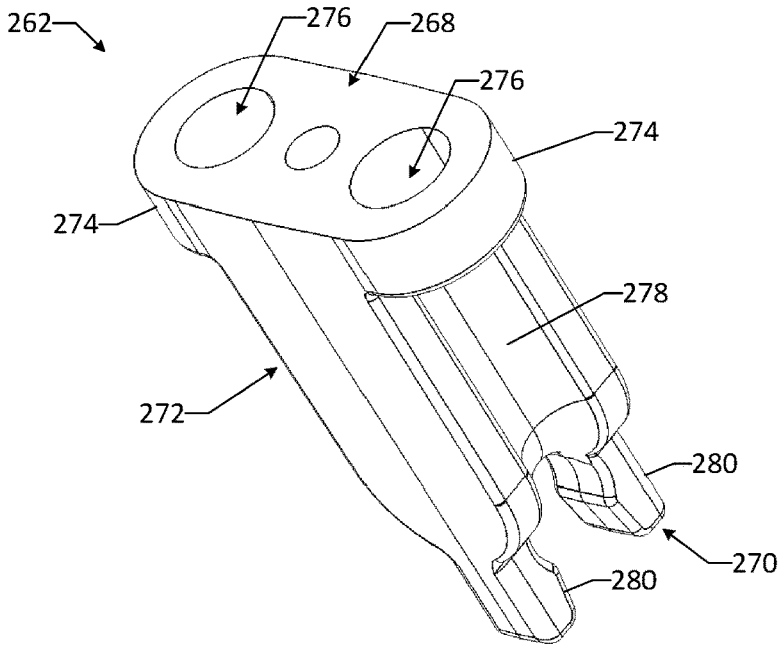
FIG. 2M is a top perspective view of the clip of the flowable material container of FIG. 2K.
Figure 2N:
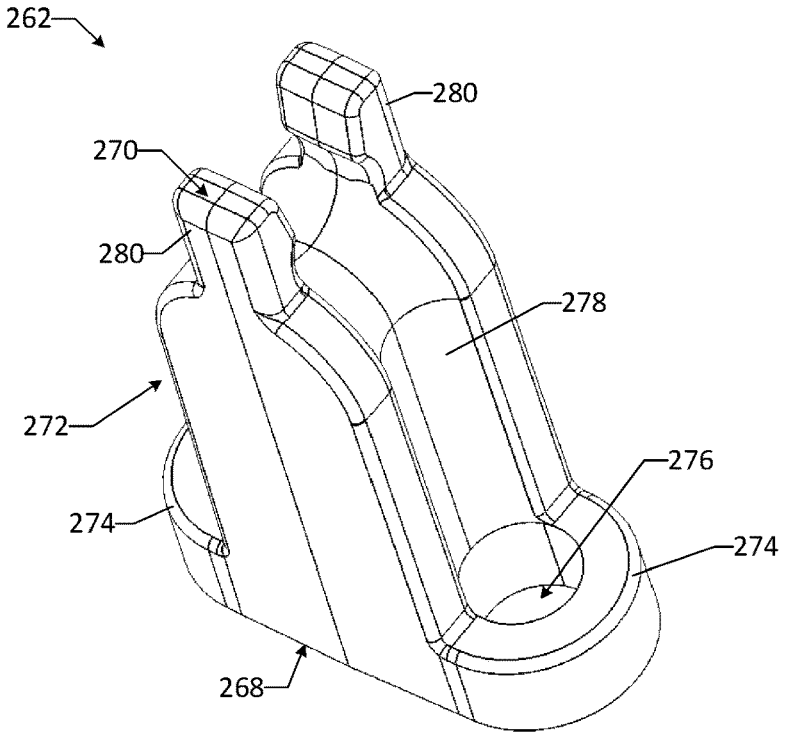
FIG. 2N is a bottom perspective view of the clip of the flowable material container of FIG. 2K.

FIGS. 1A-1X illustrate an automated flowable material dispenser 100 (which also may be referred to herein as a "flowable material dispenser," an "automated dispenser," or a "dispenser") according to one or more embodiments of the disclosure. The automated flowable material dispenser 100 is configured to dispense flowable material from a supply of flowable material supported thereby. In particular, the dispenser 100 may be configured to dispense flowable material from a flowable material container 200, as described below with respect to FIGS. 2A-3E. In certain applications, the dispenser 100 may be associated with a sheet product dispenser in a particular operating environment, such as a bathroom, a wash station, or other environment used for personal hygiene or cleaning purposes. The dispenser 100 may be mounted to, positioned adjacent to, or positioned near the sheet product dispenser, such that a user may dispense a portion of sheet product from the sheet product dispenser and then dispense an amount of flowable material from the dispenser 100 onto the sheet product for subsequent use. In this manner, the dispenser 100 may allow the user to moisten the sheet product with the flowable material for improved personal hygiene or cleaning use. As described below, the dispenser 100 may include an automated dispensing mechanism having a robust and relatively simple configuration that includes a limited number of components for dispensing the flowable material from the replaceable flowable material container 200, may ensure that a substantially consistent amount of the flowable material is dispensed during each dispense cycle, may be able to dispense the entire, or substantially the entire, supply of flowable material from the container 200, may control the dispensing pattern of the flowable material such that the flowable material may be evenly applied to the sheet product or other substrate, may allow the depleted container 200 to be quickly and easily replaced with a new prefilled container 200, and/or may ensure that the container 200 is properly installed to allow desired operation of the automated dispensing mechanism.

FIGS. 2A-2F illustrate a flowable material container 200 (which also may be referred to herein as a "refill container," a "refill," or a "container") according to one or more embodiments of the disclosure. The flowable material container 200 is configured to contain a flowable material and to allow the flowable material to be dispensed therefrom. In particular, the container 200 may be used with the automated flowable material dispenser 100 to dispense the flowable material therefrom, as described below. As shown, the container 200 may include a reservoir 202 (which also may be referred to herein as a "bottle"), a pump 204 (which also may be referred to herein as a "pump assembly"), and a nozzle cap 206 (which also may be referred to herein as an "actuator"). The reservoir 202 may be configured to contain a supply of the flowable material therein. As shown, the reservoir 202 may have an open end 208 and a closed end 210. In certain embodiments, as shown, the reservoir 202 may be formed of a transparent or translucent material to facilitate visualization of the supply of flowable material contained therein. In certain embodiments, the reservoir 202 may be rigid or substantially rigid in the direction of the longitudinal axis thereof (i.e., the direction from the open end 208 to the closed end 210). As described below, the rigid or substantially rigid nature of the reservoir 202 may facilitate dispensing of the flowable material from the reservoir 202. In certain embodiments, the reservoir 202 may be a bag or a collapsible bottle. In certain embodiments, the reservoir 202 may be formed of a plastic material, although other materials may be used. In certain embodiments, as shown, the reservoir 202 may have an elongated generally cylindrical shape and a circular cross-sectional shape, although other shapes may be used. In certain embodiments, the flowable material contained within the reservoir 202 may be a liquid, such as a cleansing liquid, although other types of flowable materials may be used. In certain embodiments, the flowable material contained within the reservoir 202 may be an air freshener.

The pump 204 may be configured to move the flowable material out of the reservoir 202. In particular, the pump 204 may be configured to move a portion of the flowable material out of the reservoir 202 during each actuation cycle of the pump 204. As shown, the pump 204 may have an elongated shape, with an inlet end 212 and an outlet end 214 positioned opposite one another in the direction of the longitudinal axis of the pump 204. In certain embodiments, as shown, the pump 204 may be a linear reciprocating piston pump configured to move the flowable material in the direction of the longitudinal axis of the pump 204. Although the pump 204 is shown as a unitary body in the drawings for illustration purposes, it will be understood that the pump 204 may include multiple components configured to cooperate with one another to move the flowable material therethrough. As shown, the pump 204 may include a siphon 216 positioned about the inlet end 212 of the pump 204, and an outlet tube 218 positioned about the outlet end 214 of the pump 204. When the pump 204 is attached to the reservoir 202, the siphon 216 may be positioned within the interior space of the reservoir 202, and the outlet tube 218 may be positioned outside of the reservoir 202. The pump 204 also may include a base ring 220 and a cap ring 222. As shown, the base ring 220 may abut the reservoir 202 to contain the flowable material therein, and the cap ring 222 may receive a portion of the nozzle cap 206 therein. The components of the pump 204 may be formed of various materials, including plastics, elastomers, metals, composites, or other materials.

The nozzle cap 206 may be configured to actuate the pump 204 and to dispense the flowable material from the container 200. In particular, the nozzle cap 206 may actuate the pump 204 when the nozzle cap 206 is moved relative to the pump 204 (and the reservoir 202) in the direction of the longitudinal axis of the container 200 or when the pump 204 (and the reservoir 202) is moved relative to the nozzle cap 206 in the direction of the longitudinal axis of the container 200. As shown, the nozzle cap 206 may have an elongated shape, with an inlet end 224 and an outlet end 226 positioned opposite one another in the direction of the longitudinal axis of the nozzle cap 206. In certain embodiments, as shown, the nozzle cap 206 may have a generally cylindrical shape and a circular cross-sectional shape, although other shapes may be used. The nozzle cap 206 may include a base ring 228 positioned about the inlet end 224 of the cap 206, a tip portion 230 positioned about the outlet end 226 of the cap 206, and a flange 232 positioned axially between the base ring 228 and the tip portion 230. As shown, the base ring 228 may extend radially outward beyond the tip portion 230, and the flange 232 may extend radially outward beyond the base ring 228. The nozzle cap 206 also may include an inner ring 234 positioned radially inward from the base ring 228. As shown, when the nozzle cap 206 is attached to the pump 204, the base ring 228 of the cap 206 may be positioned at least partially within the cap ring 222 of the pump 204, and the inner ring 234 may be positioned over at least a portion of the outlet tube 218 of the pump 204. In certain embodiments, the inner ring 234 may be press-fit onto the outlet tube 218. The tip portion 230 may include a plurality of apertures 236 extending therethough and in fluid communication with the lumen of the inner ring 234. In this manner, when the nozzle cap 206 is attached to the pump 204, the apertures 236 may be in fluid communication with the lumen of the outlet tube 218 of the pump 204 and configured to allow the flowable material to be dispensed therethrough. In certain embodiments, the nozzle cap 206 may be rigid or substantially rigid in the direction of the longitudinal axis thereof (i.e., the direction from the inlet end 224 to the outlet end 226). As described below, the rigid or substantially rigid nature of the nozzle cap 206 may facilitate dispensing of the flowable material from the container 200. In certain embodiments, the nozzle cap 206 may be formed of a plastic material, although other materials may be used. Other features and attributes of the reservoir 202, the pump 204, and the nozzle cap 206 will be appreciated from the corresponding drawings and the functional description of these components provided herein.

As described below, the flowable material container 200 may be used in an inverted orientation with the automated flowable material dispenser 100. In other words, during use, the container 200 may be oriented with the outlet end 226 of the nozzle cap 206 facing downward and the closed end 210 of the reservoir 202 facing upward. It will be appreciated that the inverted orientation of the container 200 may present challenges in dispensing the entire supply of the flowable material from the container 200. In particular, with the container 200 in the inverted orientation, the pump 204 may not be able to move the remaining flowable material from the reservoir 202 when the inlet end 212 of the pump 204 (i.e., the tip of the siphon 216) is no longer submerged in the flowable material.

In certain embodiments, as shown in FIGS. 2G-2J, the flowable material container 200 may include a siphon tube 240 (which also may be referred to as a "siphon cap"). The siphon tube 240 may have an elongated shape, as shown, with an open end 242 and a closed end 244 positioned opposite one another in the direction of the longitudinal axis of the siphon tube 240. As shown, the siphon tube 240 may be formed as a hollow member defining an interior space 246 therein. A portion of the interior space 246 of the siphon tube 240 may generally correspond to the shape of the siphon 216 of the pump 204. In this manner, the siphon tube 240 may be positioned over at least a portion of the siphon 216. In particular, the interior space 246 may include a plurality of generally cylindrical regions of varying diameters corresponding to the cylindrical regions of the siphon 216. In certain embodiments, the siphon tube 240 may be press fit onto the siphon 216. The siphon tube 240 also may include a plurality of protrusions 248 extending radially into the interior space 246 and positioned adjacent to the closed end 244. As shown, the protrusions 248 may abut the tip end of siphon 216 such that the tip end of the siphon 216 is axially spaced apart from the closed end 244 of the siphon tube 240. The siphon tube 240 also may include a port 250 extending from the radially outer surface of the siphon tube 240 to the interior space 246. In particular, the port 250 may be in fluid communication with a channel 252 defined within the siphon tube 240. As shown, the channel 252 may extend axially from the port 250 to the closed end 244 of the siphon tube 240. In this manner, the port 250, the channel 252, and the tip portion of the interior space 246 may define a pathway for the flowable material to pass through the port 250, through the channel 252, and into the siphon 216 of the pump 204. Accordingly, when the container 200 is in the inverted orientation, the pump 204 may be able to move the flowable material from the reservoir 202 as long as the port 250 of the siphon tube 240 is submerged in the flowable material. In this manner, the siphon tube 240 may allow dispensing of the entire, or substantially the entire, supply of the flowable material from the container 200. As shown, the siphon tube 240 also may include a shroud 254 positioned along the radially outer surface thereof and extending at least partially around the port 250. The shroud 254 may be configured to direct air around the port 250 during operation of the pump 204. In this manner, the shroud 254 may reduce the amount of air that is picked up by the pump 204 during venting, thereby maximizing the amount of the flowable material that is moved by the pump 204 during each actuation cycle and ensuring that a substantially consistent amount of the flowable material is dispensed per actuation cycle. In certain embodiments, the siphon tube 240 may be formed of a plastic material, such as polypropylene, although other materials may be used. Other features and attributes of the siphon tube 240 will be appreciated from the corresponding drawings and the functional description of the siphon tube 240 provided herein.

In certain embodiments, as shown in FIGS. 2K-2N, the flowable material container 200 may include a dip tube 260 and a clip 262 (which also may be referred to as a "dip tube clip"). The dip tube 260 may formed as an elongated tubular member, with an inlet end 264 and an outlet end 266 positioned opposite one another in the direction of the longitudinal axis of the dip tube 260. The dip tube 260 may have a lumen extending therethrough from the inlet end 264 to the outlet end 266. As shown, the dip tube 260 may be formed of a flexible material, such as a plastic or elastomeric material, although other suitably flexible materials may be used. When the dip tube 260 is attached to the pump 204, a first portion of the dip tube 260 including the inlet end 264 may be positioned within the reservoir 202, and a second portion of the dip tube 260 including the outlet end 266 may be positioned within the siphon 216 of the pump 204. In this manner, the pump 204 may draw the flowable material from the reservoir 202 through the dip tube 260. In certain embodiments, the second portion of the dip tube 260 may be press-fit into the siphon 216.

As shown, the clip 262 may be configured to maintain the dip tube 260 in a curved, generally U-shaped configuration. The clip 262 may have an elongated shape, with a first end 268 and a second end 270 positioned opposite one another in the direction of the longitudinal axis of the clip 262. As shown, the clip 262 may include a central body 272 and a pair of wings 274 extending laterally outward from the central body 272. The wings 274 may be positioned opposite one another and about the first end 268 of the clip 262. Each wing 274 may include an opening 276 extending therethrough in the direction of the longitudinal axis of the clip 262. As shown, the openings 276 may be configured to allow the dip tube 260 to extend therethrough. The central body 272 may include a channel 278 defined along the outer surface of the central body 272 and extending between the openings 276. In this manner, the channel 278 may receive a portion of the dip tube 260 therein and facilitate the curved configuration of the dip tube 260, as shown. The clip 262 also may include a pair of retention tabs 280 spaced apart from one another and extending axially from the central body 272. The retention tabs 280 may be positioned about the second end 270 of the clip 262, although other positions may be used. As shown, the retention tabs 280 may be positioned along the channel 278 and configured to retain the curved portion of the dip tube 260 in the channel 278. When the clip 262 is attached to the dip tube 260, the clip 262 may position the inlet end 264 of the dip tube 260 near the open end 208 of the reservoir 202, such that the inlet end 264 is positioned closer to the open end 208 than the tip of the siphon 216 of the pump 204. Accordingly, when the container 200 is in the inverted orientation, the pump 204 may be able to move the flowable material from the reservoir 202 as long as the inlet end 264 of the dip tube 260 is submerged in the flowable material. In this manner, the dip tube 260 and the clip 262 may allow dispensing of the entire, or substantially the entire, supply of the flowable material from the container 200. In certain embodiments, the clip 262 may be formed of a plastic material, such as polypropylene, although other materials may be used. Other features and attributes of the dip tube 260 and the clip 262 will be appreciated from the corresponding drawings and the functional description of these components provided herein.

Returning to FIGS. 1A-1X, the automated flowable material dispenser 100 may have an elongated shape, with a front side 101, a back side 102, a top end 103, and a bottom end 104. The dispenser 100 may include a housing 110 configured to contain the flowable material container 200 and various components of the dispenser 100 therein. As shown, the housing 100 may include a first housing portion 111 ("which also may be referred to herein as a "front interior housing portion"), a second housing portion 112 ("which also may be referred to herein as a "back interior housing portion"), a third housing portion 113 ("which also may be referred to herein as a "top exterior housing portion" or a "top cover"), a fourth housing portion 114 ("which also may be referred to herein as a "bottom exterior housing portion" or a "bottom cover"), a fifth housing portion 115 ("which also may be referred to herein as a "front exterior housing portion" or a "front cover"), and a sixth housing portion 116 ("which also may be referred to herein as a "back exterior housing portion" or a "back cover"). The dispenser 100 also may include a mounting bracket 120 attached to the housing 110 and configured to facilitate mounting of the dispenser 100 to a wall or other work surface, such as via one or more fasteners. The housing portions 111, 112, 113, 114, 115, 116 and the mounting bracket 120 may be rigid or substantially rigid and may be formed of a plastic material, although other suitable materials may be used. As shown, the housing portions 111, 112, 113, 114, 115, 116 and the mounting bracket 120 may be separately formed and attached to one another.

The first housing portion 111, as shown in detail in FIGS. 1H and 1I, may be formed as an elongated member including various features for cooperating with the container 200 and engaging other portions of the housing 110. The first housing portion 111 may include a front wall 121, a back wall 122, a bottom wall 123, and a pair of side walls 124. As shown, the first housing portion 111 may include a reservoir receptacle 125, a nozzle cap opening 126, a nozzle cap slot 127, and a motor opening 128 defined therein. During use of the dispenser 100, the reservoir receptacle 125 may be configured to receive a portion of the reservoir 202 of the container 200 therein, and the nozzle cap opening 126 may be configured to receive the tip portion 230 of the nozzle cap 206 therein. The nozzle cap slot 127 may be configured to guide the nozzle cap 206 toward the nozzle cap opening 126 as the container 200 is inserted into the dispenser 100. The motor opening 128 may allow a portion of a motor assembly of the dispenser 100 to pass therethrough and engage the reservoir 202 of the container 200 during use of the dispenser 100.

As shown, the first housing portion 111 may be attached to the second housing portion 112, the third housing portion 113, the fourth housing portion 114, and the fifth housing portion 115. The first housing portion 111 may include a plurality of first tabs 129 extending from the side walls 124 and configured to engage mating protrusions of the second housing portion 112. As shown, each of the first tabs 129 may include a recess 130 defined therein and configured to receive a portion of the mating protrusion. The first housing portion 111 may include a plurality of first protrusions 131 extending from the interior side of the front wall 121 near the top end thereof and configured to engage mating tabs of the third housing portion 113. As shown, the first protrusions 131 may have a ramped shape to facilitate a snap-fit connection. The first housing portion 111 also may include a plurality of second protrusions 132 extending from the interior sides of the side walls 124 near the bottom end thereof and configured to engage mating tabs of the fourth housing portion 114. As shown, the second protrusions 132 may have a ramped shape to facilitate a snap-fit connection. The first housing portion 111 may further include one or more second tabs 133 extending along the front wall 121 near the top end thereof and configured to engage a mating protrusion of the fifth housing portion 115, and a plurality of slots 134 defined in the side walls 124 and configured to engage mating tabs of the fifth housing portion. The second tab 133 may be a spring tab, as shown, to facilitate a snap-fit connection. In this manner, the first housing portion 111 may be removably attached to the second housing portion 112, the third housing portion 113, the fourth housing portion 114, and the fifth housing portion 115, as shown. Other features and attributes of the first housing portion 111 will be appreciated from the corresponding drawings and the functional description of the first housing portion 111 provided herein.

The second housing portion 112, as shown in detail in FIGS. 1J and 1K, may be formed as an elongated member including various features for supporting the motor assembly and electronic components of the dispenser 100 and engaging other portions of the housing 110. The second housing portion 112 may include a back wall 135 and a pair of side walls 136. As shown, the second housing portion 112 may include a pair of outer rails 137, a pair of inner rails 138, a rack 139, and a battery receptacle 140. The outer rails 137 may extend vertically along the interior side of the back wall 135 and be configured to guide the motor assembly during operation of the dispenser 100, as described below. In a similar manner, the inner rails 138 may extend vertically along the interior side of the back wall 135 and be configured to guide the motor assembly during operation of the dispenser 100. The inner rails 138 may be spaced apart from one another and define a T-shaped slot configured to receive a mating portion of the motor assembly and facilitate vertical translation of the motor assembly relative to the housing 110, as described below. The rack 139 may extend vertically along the interior side of the back wall 135 and be configured to engage a mating pinion of the motor assembly to control vertical translation of the motor assembly relative to the housing 110. The battery receptacle 140 may be defined along the exterior side of the back wall 135 and configured to receive a plurality of batteries therein for powering the dispenser 100.

As shown, the second housing portion 112 may be attached to the first housing portion 111, the third housing portion 113, the fourth housing portion 114, and the sixth housing portion 116. The second housing portion 112 may include a plurality of first protrusions 141 extending from the side walls 136 and configured to engage the first tabs 129 of the first housing portion 111 and be received within the respective recesses 130 of the first tabs 129. As shown, the first protrusions 141 may have a ramped shape to facilitate a snap-fit connection. The second housing portion 112 may include a plurality of second protrusions 142 extending from the side walls 136 near the top ends thereof and configured to engage mating tabs of the third housing portion 113. The second housing portion 112 also may include one or more third protrusions 143 extending from the interior side of the back wall 135 near the bottom end thereof and configured to engage a mating tab of the fourth housing portion 114. The second housing portion 112 further may include a plurality of openings 144 defined in the back wall 135 and configured to engage mating tabs of the sixth housing portion 116. As shown, one or the openings 144 may be positioned near the top end of the back wall 135 and one of the openings 144 may be positioned near the bottom end of the back wall 135. In this manner, the second housing portion 112 may be removably attached to the first housing portion 111, the third housing portion 113, the fourth housing portion 114, and the sixth housing portion 116, as shown. Other features and attributes of the second housing portion 112 will be appreciated from the corresponding drawings and the functional description of the second housing portion 112 provided herein.

The third housing portion 113, as shown in detail in FIGS. 1L and 1M, may be formed as a generally circular member including various features for engaging other portions of the housing 110. The third housing portion 113 may include a top wall 145, a back wall 146, and a pair of side walls 147. As shown, the third housing portion 113 may be attached to the first housing portion 111 and the second housing portion 112. The third housing portion 113 may include a plurality of first tabs 148 extending from the top wall 145 and configured to engage the first protrusions 131 of the first housing portion 111. As shown, the first tabs 148 may be deflectable spring tabs to facilitate a snap-fit connection. The third housing portion 113 also may include a plurality of second tabs 149 extending from the top wall 145 and configured to engage the second protrusions 142 of the second housing portion 112. As shown, the second tabs 149 may be deflectable spring tabs to facilitate a snap-fit connection. In this manner, the third housing portion 113 may be removably attached to the first housing portion 111 and the second housing portion 112, as shown. When attached, the back wall 146 and the side walls 147 may be positioned between the first housing portion 111 and the second housing portion 112, and the top wall 145 may abut the top ends of the first housing portion 111 and the second housing portion 112, as shown. Other features and attributes of the third housing portion 113 will be appreciated from the corresponding drawings and the functional description of the third housing portion 113 provided herein.

The fourth housing portion 114, as shown in detail in FIGS. 1N and 1O, may be formed as a generally circular member including various features for facilitating dispensing of the flowable material from the dispenser 100 and engaging other portions of the housing 110. The fourth housing portion 114 may include a bottom wall 150, a front wall 151, and a back wall 152. As shown, the fourth housing portion 114 may include a dispensing opening 153 extending through the bottom wall 150 and configured to allow the flowable material to be dispensed therethrough from the container 200. A dispensing guide 154 may extend around the dispensing opening 153 and be configured to control the dispensing pattern of the flowable material passing therethrough. As shown, the dispensing guide 154 may have a frustoconical shape to facilitate a conical spray pattern of the flowable material. The fourth housing portion 114 also may include a sensor opening 155 extending through the bottom wall 150 and configured to allow a sensor module positioned within the housing 110 to detect the presence of a user's hand, or a substrate such as a sheet product held by a user's hand, positioned below the dispenser 100. A sensor support 156 may extend around the sensor opening 155 and be configured to support the sensor module thereon.

As shown, the fourth housing portion 114 may be attached to the first housing portion 111 and the second housing portion 112. The fourth housing portion 114 may include a plurality of first tabs 157 extending from the bottom wall 150 and configured to engage the second protrusions 132 of the first housing portion 111. As shown, the first tabs 157 may be deflectable spring tabs to facilitate a snap-fit connection. The fourth housing portion 114 also may include one or more second tabs 158 extending from the bottom wall 150 and configured to engage the third protrusions 143 of the second housing portion 112. As shown, the second tabs 158 may be deflectable spring tabs to facilitate a snap-fit connection. In this manner, the fourth housing portion 114 may be removably attached to the first housing portion 111 and the second housing portion 112, as shown. When attached, the front wall 151 and the back wall 152 may be positioned between the first housing portion 111 and the second housing portion 112, and the bottom wall 150 may abut the bottom ends of the first housing portion 111 and the second housing portion 112, as shown. Other features and attributes of the fourth housing portion 114 will be appreciated from the corresponding drawings and the functional description of the fourth housing portion 114 provided herein.

The fifth housing portion 115, as shown in detail in FIGS. 1P and 1Q, may be formed as an elongated member including various features for cooperating with the container 200 and engaging other portions of the housing 110. The fifth housing portion 115 may include a front wall 159 and a pair of side walls 160. As shown, the fifth housing portion 115 may include a support rib 161 extending vertically along the interior surface of the front wall 159 and configured to engage and support the container 200 within the dispenser 100. In particular, the support rib 161 may be configured to engage and support the reservoir 202 of the container 200, as shown in FIGS. 3C and 3E, to maintain the container 200 in the desired inverted orientation. In this manner, the support rib 161 may ensure that the container 200 is properly oriented with respect to the dispenser 100 to allow the flowable material to be dispensed therefrom.

As shown, the fifth housing portion 115 may be attached to the first housing portion 111. The fifth housing portion 115 may include one or more protrusions 162 extending from the interior surface of the front wall 159 near the top end thereof and configured to engage the second tab 133 of the first housing portion 111. The fifth housing portion 115 also may include a plurality of tabs 163 extending from the interior surfaces of the side walls 160 and configured to engage and be received within the respective slots 134 of the first housing portion 111. In this manner, the fifth housing portion 115 may be removably attached to the first housing portion 111, as shown. Other features and attributes of the fifth housing portion 115 will be appreciated from the corresponding drawings and the functional description of the fifth housing portion 115 provided herein.

The sixth housing portion 116, as shown in detail in FIGS. 1R and 1S, may be formed as an elongated member including various features for cooperating with the batteries, attaching to the mounting bracket 120, and engaging other portions of the housing 110. The sixth housing portion 116 may include a back wall 164. As shown, the sixth housing portion 116 may include a plurality of support ribs 165 extending vertically along the interior surface of the back wall 164 and configured to engage and support the batteries positioned within the battery receptacle 140 of the second housing portion 112, as shown in FIGS. 3C and 3E. In this manner, the support ribs 165 may ensure that the batteries remain properly positioned within the dispenser 100. The sixth housing portion 116 also may include a plurality of openings extending through the back wall 164 and configured to facilitate attachment of the mounting bracket 120. As shown, the sixth housing portion 116 may include a plurality of first openings 166 each configured to allow a fastener, such as a screw, to extend therethrough and engage a mating opening of the mounting bracket 120. The sixth housing portion 116 also may include a plurality of second openings 167 each configured to receive a mating protrusion of the mounting bracket 120. In this manner, the sixth housing portion 116 may be securely attached to the mounting bracket 120.

As shown, the sixth housing portion 116 may be attached to the second housing portion 112. The sixth housing portion 116 may include a first tab 168 extending from the top end of the back wall 164, and a second tab 169 extending from the interior surface of the back wall 164 near the bottom end thereof. The first tab 168 may be configured to engage and be received within the top opening 144 of the second housing portion 112, and the second tab 169 may be configured to engage and be received within the bottom opening 144 of the second housing portion 112. As shown, the second tab 169 may be a deflectable spring tab to facilitate a snap-fit connection. In this manner, the sixth housing portion 116 may be removably attached to the fifth housing portion 115, as shown. Other features and attributes of the sixth housing portion 116 will be appreciated from the corresponding drawings and the functional description of the sixth housing portion 116 provided herein.

The mounting bracket 120, as shown in detail in FIGS. 1T and 1U, may be formed as an elongated member including various features for attaching to the sixth housing portion 116 and to a wall or other work surface. The mounting bracket 120 may include a back wall 170, a top wall 171, a bottom wall 172, and a pair of side walls 173. As shown, the mounting bracket 120 may include a plurality of first openings 174 each configured to receive a fastener, such as a screw, therein for attaching the mounting bracket 120 to the sixth housing portion 116. The mounting bracket 120 also may include a plurality of protrusions 175 extending from the interior surface of the back wall 170 and configured to engage the respective second openings 167 of the sixth housing portion 116. As shown, the mounting bracket 120 also may include one or more second openings 176 configured to receive a fastener, such as a screw, therein for attaching the mounting bracket 120 to a wall or other work surface. Other features and attributes of the mounting bracket 120 will be appreciated from the corresponding drawings and the functional description of the mounting bracket 120 provided herein.

As shown in FIGS. 1V-1X, the dispenser 100 may include a motor assembly 180 configured to engage the container 200 and facilitate dispensing of the flowable material therefrom. As described below, the motor assembly 180 may be configured to move relative to the housing 110 in order to move the reservoir 202 and the pump 204 relative to the nozzle cap 206, thereby actuating the pump 204 and causing an amount of the flowable material to be dispensed from the container 200 and out of the dispenser 100. In particular, the motor assembly 180 may be movably mounted to the second housing portion 112, as shown in FIG. 1V, and configured to translate vertically with respect to the second housing portion 112 and the overall housing 110. As shown, the motor assembly 180 may include a motor 181, a motor housing 182 (which also may be referred to herein as a "motor sleeve"), and a pinion 183. In certain embodiments, as shown, the motor 181 may be a servo motor, although other types of motors may be used. The motor 181 may include a shaft 184, and the pinion 183 may be mounted to the shaft 184 for rotation therewith. The pinion 183 may engage the rack 139 of the second housing portion 112, as shown, to facilitate vertical translation of the motor assembly 180 upon rotation of the shaft 184. The motor 181 may include a potentiometer to control the vertical position of the motor assembly 180 relative to the housing 110. As shown, the motor housing 182 may receive a portion of the motor 181 therein, and the motor 181 may be secured to the motor housing 182 via one or more fasteners, such as screws.

The motor housing 182 may be positioned between the outer rails 137 of the second housing portion 112. In this manner, the outer rails 137 may guide the motor housing 182 and maintain the orientation of the motor assembly 180 as the assembly 180 vertically translates relative to the housing 110. As shown in FIGS. 1W and 1X, the motor housing 182 may include a plurality of guide protrusions 185 extending laterally outward from the respective sides thereof. The guide protrusions 185 may be configured to engage and slide along the outer rails 137 as the motor assembly 180 vertically translates relative to the housing 110. In certain embodiments, as shown, the guide protrusions 185 may be formed as partial spheres to minimize the contact area between the motor housing 180 and the outer rails 137. Other shapes of the guide protrusions 185 configured to minimize the contact area may be used. As shown, the motor housing 180 also may include a guide rib 186 extending vertically along the back side thereof and movably received between the inner rails 138 of the second housing portion 112. In certain embodiments, as shown, the guide rib 186 may have a T-shape corresponding to the T-shape of the slot defined between the inner rails 138, although other shapes may be used. In this manner, the guide rib 186 and the inner rails 138 may be configured to maintain the orientation of the motor assembly 180 as the assembly 180 vertically translates relative to the housing 110. Other features and attributes of the motor assembly 180 will be appreciated from the corresponding drawings and the functional description of the motor assembly 180 provided herein.

As shown in FIG. 1V, the dispenser 100 also may include an electronics module 190 and a sensor module 191 attached to the second housing portion 112. The electronics module 190 may include an electronic controller 192 operable to control operation of the dispenser 100 as well as other electronic components to facilitate such operation. The sensor module 191 may be configured to detect the presence of a user's hand, or a substrate such as a sheet product held by a user's hand, positioned below the dispenser 100. In certain embodiments, as shown, the sensor module 191 may be an infrared (IR) sensor including an IR emitter 193 and an IR receiver 194, although other types of sensors may be used. The IR emitter 193 may be configured to pulse so as to determine if the feedback from the IR receiver 194 is being washed out by ambient light. In certain embodiments, the sensor module 191 may be configured to detect a user's hand, or a substrate such as a sheet product held by a user's hand, positioned within four (4) inches of the sensor module 191. As shown, the sensor module 191 may be positioned above the sensor opening 155 of the fourth housing portion 114. The electronics module 190 also may include a power button 195 extending through an opening in the second housing portion 112. The power button 195 may be a soft switch in operable communication with the controller 192. When the batteries are first installed, the dispenser 100 may start in an off mode and may be transitioned to an on mode upon depression of the power button 195. It will be appreciated that the motor 181 may require a certain battery voltage in order to operate and move the motor assembly 180. The controller 192 may be operable to transition the dispenser 100 from the on mode to the off mode based on the available battery voltage. In particular, the controller 192 may be operable to measure a dip in voltage during a dispense cycle and to transition the dispenser 100 to the off mode when the controller 192 detects that the voltage is below a predetermined threshold voltage for five (5) consecutive dispense cycles. Once the controller 192 transitions the dispenser 100 to the off mode, the batteries must be removed and replaced in order to turn the dispenser 100 back to the on mode. When the dispenser 100 is in the on mode and the sensor module 191 detects the presence of a user's hand or a substrate held by a user's hand, the controller 192 may be operable to direct the motor assembly 180 to carry out multiple dispense cycles, one after another, until the sensor module 191 no longer detects the user's hand or the substrate held by the user's hand or until a predetermined maximum number of consecutive dispense cycles has been reached. In this manner, the user may continuously dispense the flowable material to obtain a desired amount. In certain embodiments, the predetermined maximum number of consecutive dispense cycles may be twenty (20), although other numbers may be used. If the predetermined maximum number of consecutive dispense cycles is met, the controller 192 may stop the motor assembly 180. If the user desires to obtain additional flowable material, the user's hand or the substrate held by the user's hand must be removed from the detectable range of the sensor module 191 and reinserted within the detectable range, thereby causing the dispenser 100 to resume dispensing of the flowable material. Other features and attributes of the electronics module 190 and the sensor module 191 will be appreciated from the corresponding drawings and the functional description of these components provided herein.

Figure 3A:
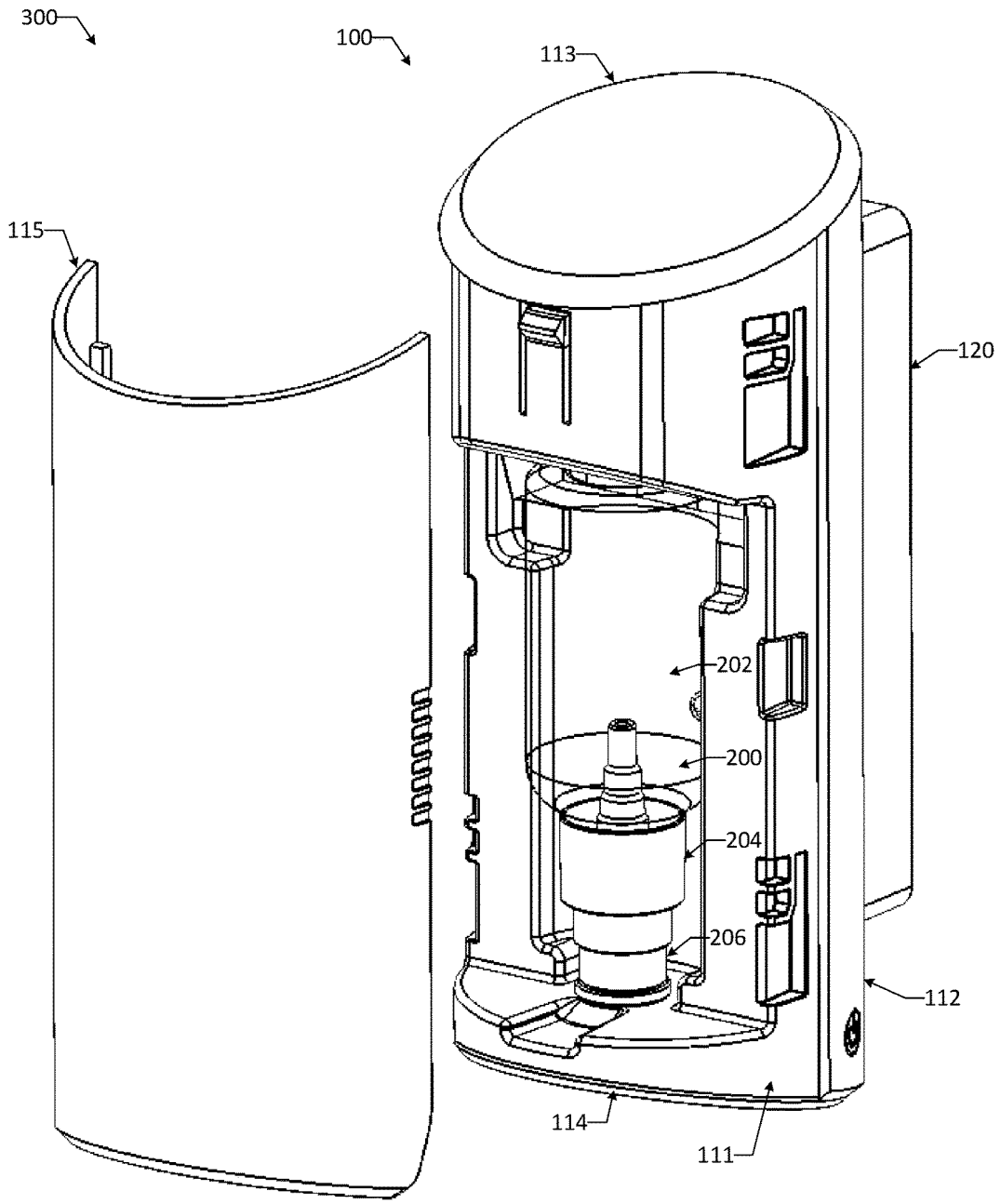
FIG. 3A is a front perspective view of an automated flowable material dispenser system in accordance with one or more embodiments of the disclosure, showing an automated flowable material dispenser and a flowable material container of the system, with a fifth housing portion of a housing of the dispenser removed from a remainder of the dispenser.
Figure 3B:
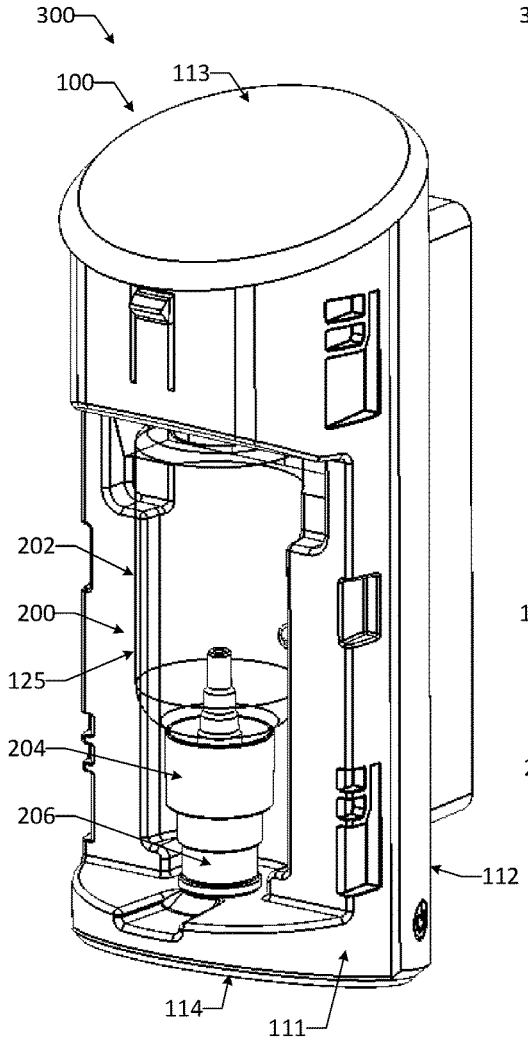
FIG. 3B is a front perspective view of the automated flowable material dispenser system of FIG. 3A, showing a motor assembly of the dispenser in a home position and the flowable material container in an unactuated configuration, with the fifth housing portion removed from view for illustration purposes.
Figure 3C:
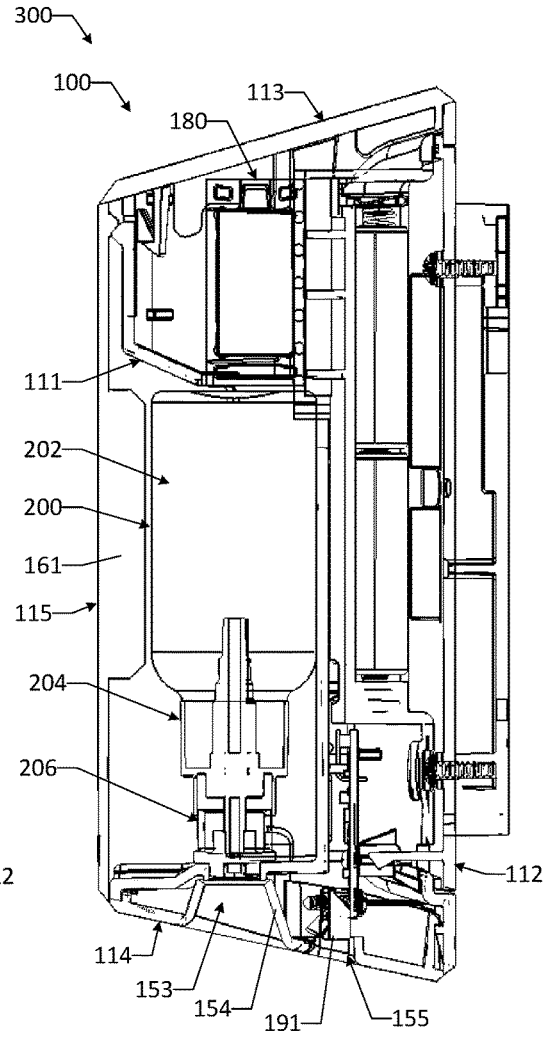
FIG. 3C is a cross-sectional side view of the automated flowable material dispenser system of FIG. 3A, showing the motor assembly in the home position and the flowable material container in the unactuated configuration.
Figure 3D:
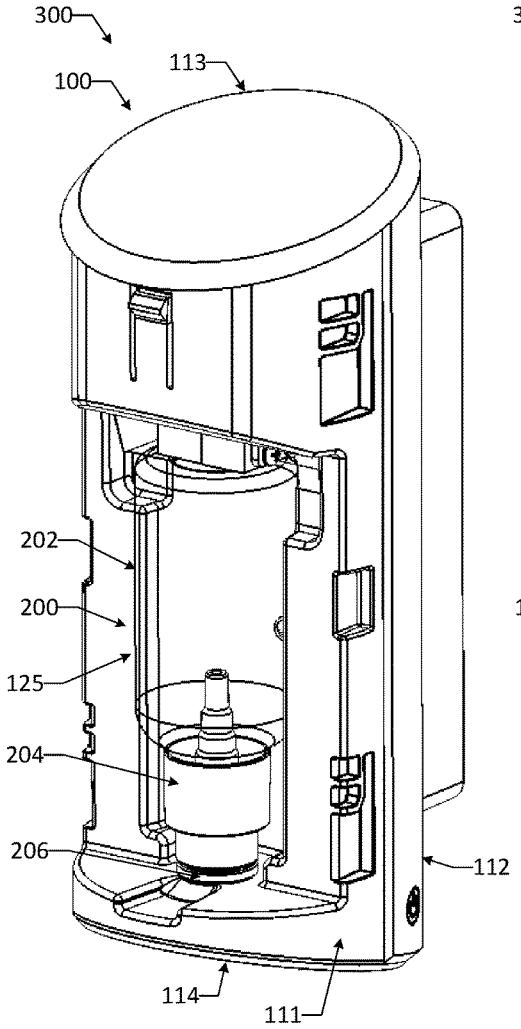
FIG. 3D is a front perspective view of the automated flowable material dispenser system of FIG. 3A, showing the motor assembly in a dispensing position and the flowable material container in an actuated configuration, with the fifth housing portion removed from view for illustration purposes.
Figure 3E:
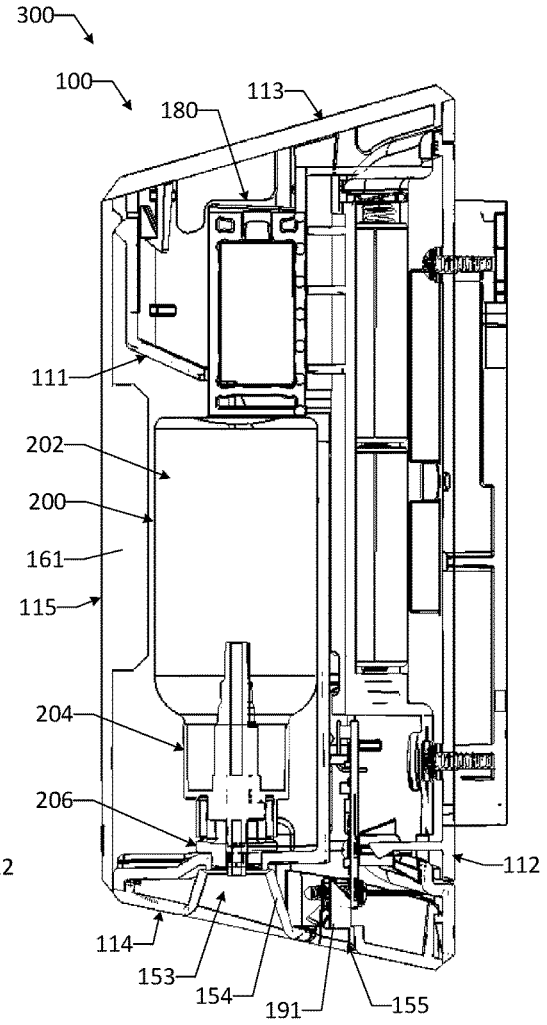
FIG. 3E is a cross-sectional side view of the automated flowable material dispenser system of FIG. 3A, showing the motor assembly in the dispensing position and the flowable material container in the actuated configuration.

FIGS. 3A-3E illustrate an automated flowable material dispenser system 300 (which also may be referred to herein as a "system") according to one or more embodiments of the disclosure. As shown, the automated flowable material dispenser system 300 may include the automated flowable material dispenser 100 and the flowable material container 200 described above. The container 200 may be prefilled with a flowable material, such as a liquid cleanser or an air freshener, although other types of flowable materials may be used. As shown in FIG. 3A, the container 200 may be loaded into the dispenser 100 by removing the fifth housing portion 115 from the remainder of the housing 110, and inserting the container 200 into the housing 100 in an inverted orientation. As described above, the reservoir 202 of the container 200 may be positioned within the reservoir receptacle 125 of the first housing portion 111, and the tip portion 230 of the nozzle cap 206 may be positioned within the nozzle cap opening 126 of the first housing portion 111. In this manner, the flange 232 of the nozzle cap 206 may rest on the bottom wall 123 of the first housing portion 111, and the tip portion 230 may be aligned with the dispensing opening 153 of the fourth housing portion 114. After positioning the container 200 within the housing 110 in this manner, the fifth housing portion 115 may be reattached to the remainder of the housing 110, such that the container 200 is positioned within an interior space defined between the first housing portion 111 and the fifth housing portion 115. As described above, the support rib 161 of the fifth housing portion 115 may engage the reservoir 202 of the container 200 to maintain the desired orientation of the container 200, as shown in FIG. 3C.

During operation of the dispenser 100, the motor assembly 180 may move between a home position (which also may be referred to herein as a "default position" or an "standby position"), as shown in FIGS. 3B and 3C, and a dispensing position (which also may be referred to herein as a "actuating position"), as shown in FIGS. 3D and 3E. In particular, the motor assembly 180 may vertically translate with respect to the housing 110 between the home position and the dispensing position. When the motor assembly 180 is in the home position, the motor housing 182 may be positioned near but spaced apart from the closed end 210 of the reservoir 202 or may engage the closed end 210 of the reservoir 202 without applying pressure to the reservoir 202. In this manner, when the motor assembly 180 is in the home position, the container 200 may be in an unactuated configuration (which also may be referred to herein as a "default configuration" or an "relaxed configuration"), as shown in FIGS. 3B and 3C. When the container 200 is in the relaxed configuration, the pump 204 is not actuated and no flowable material is dispensed from the container 200. As the motor assembly 180 moves from the home position to the dispensing position, the motor housing 182 may engage the closed end 210 of the reservoir 202 and apply pressure to the reservoir 202. In this manner, as the motor assembly 180 moves from the home position to the dispensing position, the motor housing 182 may translate the reservoir 202 and the pump 204 vertically downward with respect to the nozzle cap 206 and the housing 110 while the nozzle cap 206 remains stationary with respect to the housing 110. Accordingly, as the motor assembly 180 moves from the home position to the dispensing position, the container 200 may move from the unactuated configuration to an actuated configuration (which also may be referred to herein as a "compressed configuration"), as shown in FIGS. 3D and 3E. As the container 200 moves from the unactuated configuration to the actuated configuration, the pump 204 is actuated by the relative movement of the reservoir 202 and the pump 204 with respect to the nozzle cap 206, thereby causing the container 200 to dispense an amount of the flowable material therefrom. As described above, the flowable material may be dispensed downward through the dispensing opening 153 of the fourth housing portion 114, and the dispensing guide 154 may control the dispensing pattern of the flowable material to have a conical spray pattern. After the motor assembly 180 moves to the dispensing position and causes the container 200 to assume the actuated configuration, the motor assembly 180 may return to the home position, thereby allowing the container 200 to return to the unactuated configuration and completing a dispense cycle. As described above, a dispense cycle may be initiated by the controller 192 when the sensor module 191 detects the presence of a user's hand or a substrate held by a user's hand below the dispenser 100. In particular, the controller 192 may be operable to drive the motor 181 in a first direction to move the motor assembly 180 from the home position to the dispensing position and then drive the motor 181 in an opposite second direction to move the motor assembly 180 from the dispensing position to the home position. Multiple dispense cycles may be carried out in sequence until the sensor module 191 no longer detects the presence of the user's hand or the substrate held by the user's hand. In this manner, the user may continue to dispense the flowable material until a desired amount is obtained. Other aspects of operation of the dispenser 100 and the container 200 will be appreciated from the corresponding drawings and the functional description provided herein.

FIGS. 4A-4D illustrate an automated flowable material dispenser 400 (which also may be referred to herein as a "flowable material dispenser," an "automated dispenser," or a "dispenser") according to one or more embodiments of the disclosure. The automated flowable material dispenser 400 is configured to dispense flowable material from a supply of flowable material supported thereby. It will be appreciated that the dispenser 400 is substantially similar to the dispenser 100 described above, with similar components and features identified by the same reference numbers. Notably, the dispenser 400 does not include the mounting bracket 120 described above. Instead, the dispenser 400 includes a mounting bracket 420, as shown.

Figure 4A:
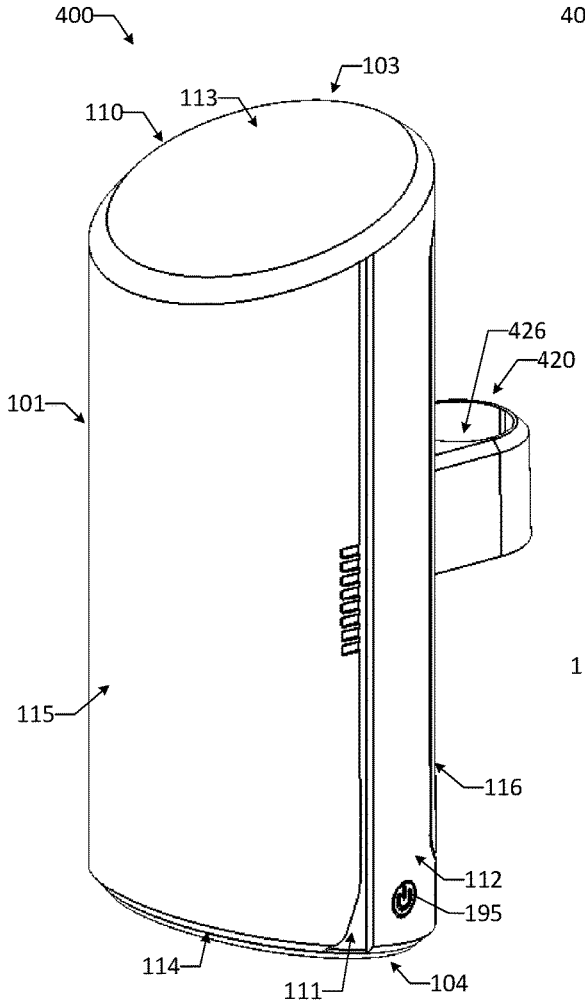
FIG. 4A is a front perspective view of an automated flowable material dispenser in accordance with one or more embodiments of the disclosure, showing a housing and a mounting bracket of the dispenser.
Figure 4B:
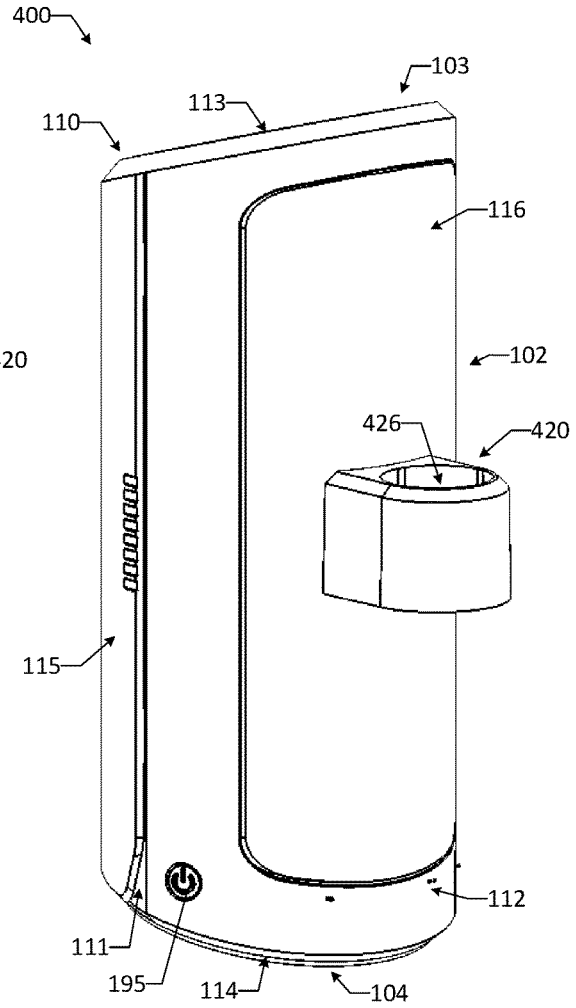
FIG. 4B is a back perspective view of the automated flowable material dispenser of FIG. 4A.
Figure 4C:
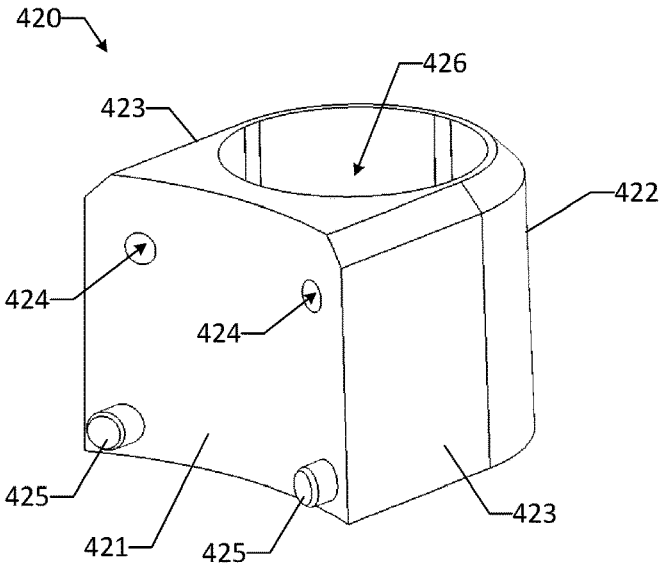
FIG. 4C is a front perspective view of the mounting bracket of the automated flowable material dispenser of FIG. 4A.
Figure 4D:
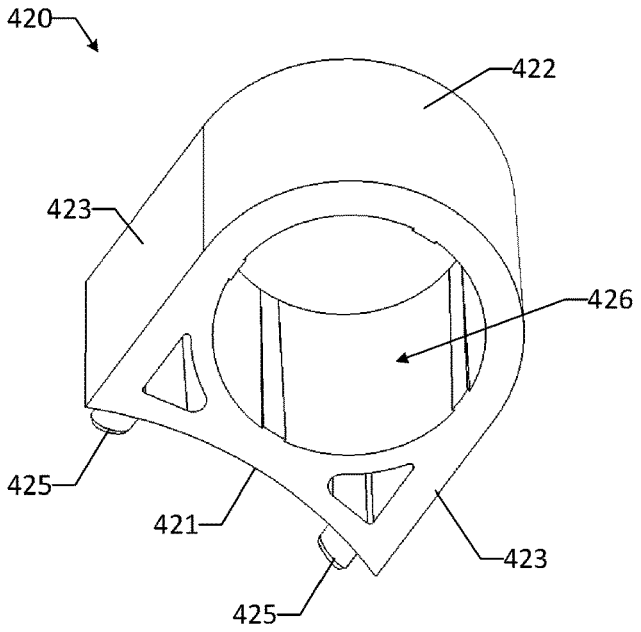
FIG. 4D is a bottom perspective view of the mounting bracket of the automated flowable material dispenser of FIG. 4A.
Figure 4E:
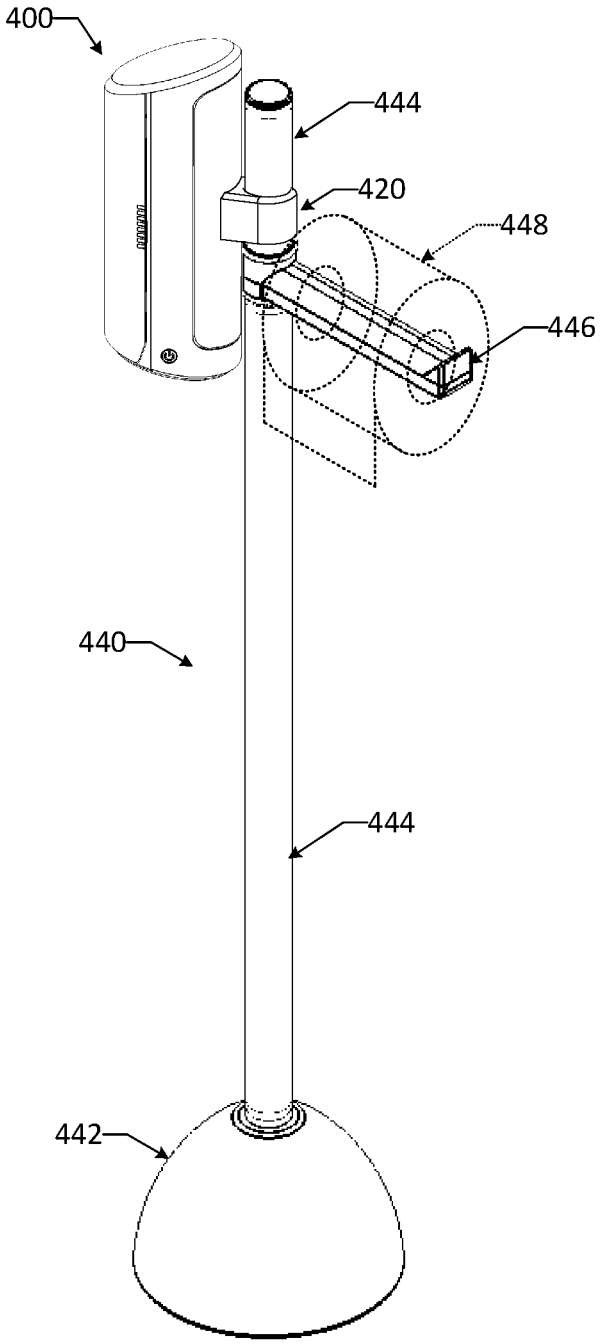
FIG. 4E is a perspective view of the automated flowable material dispenser of FIG. 4A mounted to a dispenser stand in accordance with one or more embodiments of the disclosure, showing a base, a dispenser support, and a sheet product support of the dispenser stand.

The mounting bracket 420, as shown in detail in FIGS. 4C and 4D, may be formed as an annular member including various features for attaching to the sixth housing portion 116 and to a stand or other support structure. For example, the mounting bracket 420 may facilitate attachment of the dispenser 400 to a stand 440, as shown in FIG. 4E. The mounting bracket 420 may include a front wall 421, a back wall 422, and a pair of side walls 423. As shown, the mounting bracket 420 may include a plurality of first openings 424 each configured to receive a fastener, such as a screw, therein for attaching the mounting bracket 420 to the sixth housing portion 116. The mounting bracket 420 also may include a plurality of protrusions 425 extending from the front wall 421 and configured to engage the respective second openings 167 of the sixth housing portion 116. As shown, the mounting bracket 420 also may include a central opening 426 extending therethrough along the vertical axis of the bracket 420 and configured to receive a portion of a stand or other support structure therein to facilitate mounting of the dispenser 400 to the stand or support structure.

FIG. 4E illustrates a stand 440 (which also may be referred to herein as a "sheet product dispenser" or a "dispenser") according to one or more embodiments of the disclosure, with the dispenser 400 attached thereto. As shown, the stand 440 may include a base 442, a dispenser support 444, and a sheet product support 446 attached to one another. The base 442 may be configured to rest on a floor or other support structure in a working environment, such as a bathroom. The dispenser support 444 may be attached to the base 442 and extend upwardly therefrom. In certain embodiments, as shown, the dispenser support 44 may be formed as an elongated member oriented in a vertical manner, although other shapes and orientations may be used. The sheet product support 446 may be attached to the dispenser support 444 near but spaced apart from the top end thereof and may extend radially outward from the dispenser support 444. The sheet product support 446 may be configured to support a supply of sheet product 448 (illustrated via dashed lines). In certain embodiments, as shown, the sheet product support 446 may be formed as an elongated member, such as a rod or spindle, and the sheet product 448 may be a roll of sheet product positioned at least partially over the sheet product support 446. In other embodiments, the sheet product support 446 may have other shapes, and the sheet product 448 may be a stack of sheet product or other configuration of sheet product for dispensing from the support 446.

As shown, the dispenser 400 may be mounted to the stand 440 via the mounting bracket 420. In particular, the dispenser support 444 may extend through the central opening 426 of the mounting bracket 420 and support the dispenser 400 thereby. In this manner, the dispenser 400 may be conveniently located adjacent to the sheet product support 446, such that a user may dispense a portion of the sheet product 448 and then dispense an amount of the flowable material from the dispenser 400 onto the sheet product 448 for personal hygiene or cleansing use. Other features and attributes of the dispenser 400 and the stand 440 will be appreciated from the corresponding drawings and the functional description provided herein.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific automated product dispenser configurations, it will be appreciated that numerous other automated product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. An automated flowable material dispenser for dispensing flowable material from a flowable material container, the dispenser comprising:

a dispenser housing configured to receive the flowable material container therein, the dispenser housing comprising a dispensing opening;

a motor housing positioned within the dispenser housing; and a motor positioned within the dispenser housing and at least partially within the motor housing;

wherein the motor housing and the motor are configured to translate with respect to the dispenser housing between a home position and a dispensing position to dispense the flowable material from the flowable material container.

2. The automated flowable material dispenser of claim 1, further comprising a pinion mounted to a shaft of the motor, wherein the dispenser housing further comprises a rack engaging the pinion.

3. The automated flowable material dispenser of claim 1, wherein the dispenser housing further comprises a receptacle configured to receive the flowable material container therein, and wherein the motor housing and the motor are positioned above the receptacle.

4. The automated flowable material dispenser of claim 1, wherein the dispenser housing further comprises a pair of rails configured to maintain an orientation of the motor housing and the motor as the motor housing and the motor translate with respect to the dispenser housing between the home position and the dispensing position.

5. The automated flowable material dispenser of claim 4, wherein the rails define a T-shaped slot therebetween, and wherein the motor housing comprises a T-shaped rib positioned within the slot.

6. The automated flowable material dispenser of claim 1, wherein the motor housing and the motor are configured to translate vertically with respect to the dispenser housing between the home position and the dispensing position.

7. The automated flowable material dispenser of claim 1, wherein the motor comprises a servo motor.

8. A method of dispensing flowable material from a flowable material container using an automated flowable material dispenser, the method comprising:

receiving the flowable material container within a dispenser housing of the dispenser wherein the flowable material container comprises:

a reservoir containing the flowable material therein;

a pump attached to the reservoir; and a nozzle cap attached to the pump; and translating a motor of the dispenser with respect to the dispenser housing between a home position and a dispensing position to dispense the flowable material from the flowable material container, wherein the motor is positioned within the dispenser housing.

9. The method of claim 8, wherein the motor is positioned at least partially within a motor housing, and wherein translating the motor with respect to the dispenser housing between the home position and the dispensing position comprises translating the motor housing and the motor between the home position and the dispensing position.

10. The method of claim 8, wherein the flowable material container is received within the dispenser housing in an inverted orientation such that an outlet end of the nozzle cap faces downward.

11. The method of claim 8, wherein translating the motor with respect to the dispenser housing between the home position and the dispensing position comprises translating the reservoir with respect to the nozzle cap.

12. The method of claim 11, wherein translating the reservoir with respect to the nozzle cap comprises translating the reservoir with respect to the dispenser housing and maintaining the nozzle cap stationary with respect to the dispenser housing.

13. The method of claim 8, wherein translating the motor with respect to the dispenser housing between the home position and the dispensing position comprises moving the flowable material container between an unactuated configuration and an actuated configuration.

14. The method of claim 8, wherein the flowable material is a liquid, and wherein the method further comprises dispensing the flowable material onto a sheet product.

15. An automated flowable material dispenser system for dispensing flowable material, the system comprising:

an automated flowable material dispenser comprising:

a dispenser housing comprising a dispensing opening; and a motor positioned within the dispenser housing; and a flowable material container positioned within the dispenser housing, wherein the flowable material container comprises:

a reservoir containing a flowable material therein;

a pump attached to the reservoir; and a nozzle cap attached to the pump;

wherein the motor is configured to translate with respect to the dispenser housing between a home position and a dispensing position to dispense the flowable material from the flowable material container.

16. The automated flowable material dispenser system of claim 15, wherein the automated flowable material dispenser further comprises a motor housing positioned within the dispenser housing, and wherein the motor housing and the motor are configured to translate with respect to the dispenser housing between the home position and the dispensing position.

17. The automated flowable material dispenser system of claim 15, wherein the flowable material container is positioned within the dispenser housing in an inverted orientation such that an outlet end of the nozzle cap faces downward.

18. The automated flowable material dispenser system of claim 15, wherein the motor is configured to translate the reservoir with respect to the nozzle cap and the dispenser housing when the motor translates with respect to the dispenser housing between the home position and the dispensing position.

19. The automated flowable material dispenser system of claim 15, wherein the automated flowable material dispenser further comprises a pinion mounted to a shaft of the motor, wherein the dispenser housing further comprises a rack engaging the pinion, and wherein the motor comprises a servo motor.

20. The automated flowable material dispenser system of claim 15, wherein the flowable material is a liquid.

* * * * *